US010324392B2

(12) United States Patent
Uemura

(10) Patent No.: US 10,324,392 B2
(45) Date of Patent: Jun. 18, 2019

(54) ELECTROSTATIC LATENT IMAGE DEVELOPING TONER AND TWO-COMPONENT DEVELOPER

(71) Applicant: KYOCERA Document Solutions Inc., Osaka (JP)

(72) Inventor: Hiroki Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/012,873

(22) Filed: Jun. 20, 2018

(65) Prior Publication Data

US 2018/0373173 A1 Dec. 27, 2018

(30) Foreign Application Priority Data

Jun. 22, 2017 (JP) ..... 2017-122254

(51) Int. Cl.

| | |
|---|---|
| ***G03G 9/093*** | (2006.01) |
| ***G03G 9/08*** | (2006.01) |
| ***G03G 9/083*** | (2006.01) |
| ***G03G 9/087*** | (2006.01) |

(52) U.S. Cl.

CPC ..... *G03G 9/09321* (2013.01); *G03G 9/0825* (2013.01); *G03G 9/0833* (2013.01); *G03G 9/0837* (2013.01); *G03G 9/08755* (2013.01); *G03G 9/09307* (2013.01); *G03G 9/09342* (2013.01); *G03G 9/09371* (2013.01); *G03G 9/09392* (2013.01)

(58) Field of Classification Search

CPC .... G03G 9/083; G03G 9/0836; G03G 9/0837; G03G 9/093; G03G 9/0935; G03G 9/09385

See application file for complete search history.

(56) References Cited

U.S. PATENT DOCUMENTS

| | | | |
|---|---|---|---|
| 6,656,653 | B2 | 12/2003 | Mitsuhashi et al. |
| 7,169,526 | B2 | 1/2007 | Ishikawa et al. |
| 2001/0033982 | A1 | 10/2001 | Ishikawa et al. |
| 2002/0042012 | A1 | 4/2002 | Mitsuhashi et al. |
| 2004/0146794 | A1 | 7/2004 | Mitsuhashi et al. |
| 2007/0065744 | A1 | 3/2007 | Ishikawa et al. |

(Continued)

FOREIGN PATENT DOCUMENTS

JP 2001-235894 A 8/2001

*Primary Examiner* — Peter L Vajda

(74) *Attorney, Agent, or Firm* — Studebaker & Brackett PC

(57) ABSTRACT

An electrostatic latent image developing toner includes toner particles each including a toner mother particle and an external additive. The toner mother particle includes a composite core and a shell layer. The composite core is a composite of a toner core, organic particles, and polyhedral magnetic particles. The organic particles each contain a releasing agent and adhere to a surface of the toner core. The magnetic particles include magnetic particles adhering to the surface of the toner core and magnetic particles adhering to surfaces of the organic particles. An amount of the magnetic particles is 0.5 parts by mass to 2.0 parts by mass relative to 100 parts by mass of the toner cores. In a cross-sectional image of each toner particle, an area of protruding portions of the magnetic particles, which protrude from the shell layer, accounts for 10% to 75% of an overall area of the magnetic particles.

8 Claims, 4 Drawing Sheets

(56) References Cited

U.S. PATENT DOCUMENTS

| | | | | |
|---|---|---|---|---|
| 2009/0246672 | A1 | 10/2009 | Ishikawa et al. | |
| 2014/0045114 | A1 * | 2/2014 | Mizobe ..... | G03G 9/09314<br>430/110.2 |

* cited by examiner

ELECTROSTATIC LATENT IMAGE DEVELOPING TONER AND TWO-COMPONENT DEVELOPER

INCORPORATION BY REFERENCE

The present application claims priority under 35 U.S.C. § 119 to Japanese Patent Application No. 2017-122254, filed on Jun. 22, 2017. The contents of this application are incorporated herein by reference in their entirety.

BACKGROUND

The present disclosure relates to an electrostatic latent image developing toner and a two-component developer.

A known toner is obtained by covering surfaces of toner cores having an average particle diameter of 2 μm to 20 μm with first fine resin particles, further covering the surfaces with second fine resin particles, and causing the toner cores, the first fine resin particles, and the second fine resin particles to stick or fuse together. In the above-described toner, the second fine resin particles cover surfaces of the first fine resin particles. The toner cores, the first fine resin particles, and the second fine resin particles coalesce by being caused to stick or fuse together by a thermal treatment. The toner cores contain a wax. The first fine resin particles contain a wax that is different from the wax contained in the toner cores. The first fine resin particles have a glass transition point of approximately 60° C., which is lower than a glass transition point of the second fine resin particles.

SUMMARY

An electrostatic latent image developing toner according to an aspect of the present disclosure includes toner particles each including a toner mother particle and an external additive adhering to a surface of the toner mother particle. The toner mother particle includes a composite core and a shell layer covering a surface of the composite core. The composite core is a composite of a toner core, organic particles, and polyhedral magnetic particles. The organic particles each contain a releasing agent and adhere to a surface of the toner core. The magnetic particles include magnetic particles adhering to the surface of the toner core and magnetic particles adhering to surfaces of the organic particles. An amount of the magnetic particles is at least 0.5 parts by mass and no greater than 2.0 parts by mass relative to 100 parts by mass of the toner cores. In a cross-sectional image of each toner particle, an area of protruding portions of the respective magnetic particles accounts for at least 10% and no greater than 75% of an overall area of the magnetic particles. The protruding portions protrude from the shell layer.

A two-component developer according to another aspect of the present disclosure includes the electrostatic latent image developing toner according to the aspect of the present disclosure and a carrier configured to positively charge the toner by friction therewith.

DETAILED DESCRIPTION

Figure 1:
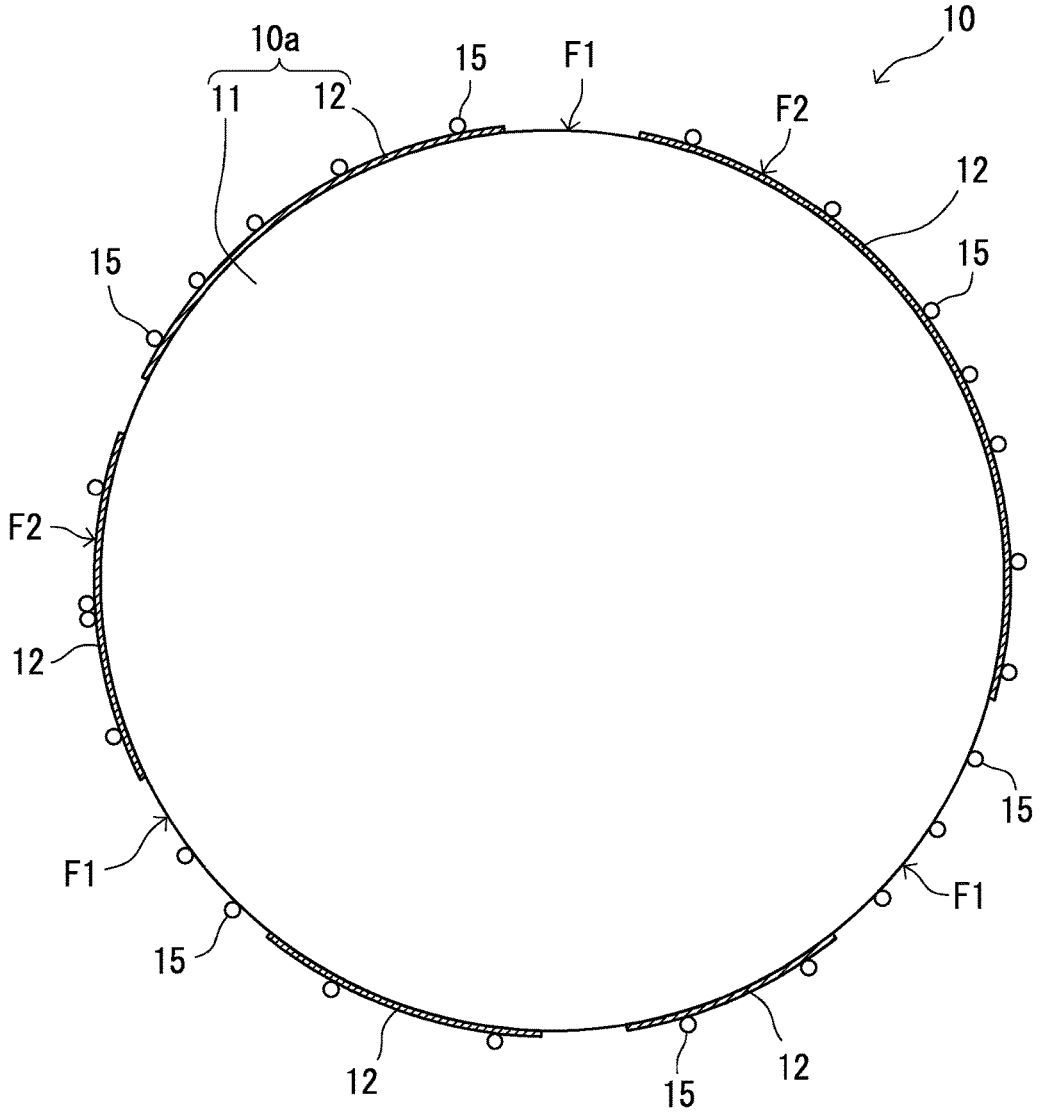
FIG. 1 is a diagram illustrating an example of a cross-sectional structure of a toner particle (particularly, toner mother particle) included in an electrostatic latent image developing toner according to an embodiment of the present disclosure.

The following describes an embodiment of the present disclosure. Unless otherwise stated, evaluation results (for example, values indicating shape and physical properties) for particles (specific examples include toner cores, toner mother particles, external additive, and toner) are each a number average of values measured for a suitable number of particles selected from among the particles.

A number average particle diameter of particles is a number average of equivalent circle diameters of primary particles thereof (diameters of circles having the same areas as projected areas of the particles) measured using a microscope, unless otherwise stated. A value for volume median diameter ($D_{50}$) of particles is measured based on the Coulter principle (electrical sensing zone technique) using "Coulter Counter Multisizer 3", product of Beckman Coulter, Inc., unless otherwise stated. A value for roundness of particles (=perimeter of a circle having the same area as a projection of a particle/perimeter of the particle) is a number average of values measured for a suitable number of particles (for example, 3,000 particles) using a flow particle imaging analyzer ("FPIA (registered Japanese trademark)-3000", product of Sysmex Corporation), unless otherwise stated. Acid values and hydroxyl values are measured in accordance with "Japanese Industrial Standard (JIS) K0070-1992", unless otherwise stated. Glass transition point (Tg), melting point (Mp), softening point (Tm), and molecular weight (Mw and Mn) are measured according to the same methods as those employed in Examples described below or alternatives thereof, unless otherwise stated.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acrylic" is used as a generic term for both acrylic and methacrylic. The term "(meth)acrylonitrile" is used as a generic term for both acrylonitrile and methacrylonitrile.

A toner according to the present embodiment is for example suitable for use as a positively chargeable toner for developing an electrostatic latent image. The toner according to the present embodiment includes toner particles (particles each having the features described below). The toner may be used as a one-component developer. Alternatively, the toner may be mixed with a carrier using a mixer (for example, a ball mill) in order to prepare a two-component developer. Examples of carriers suitable for image formation include a ferrite carrier (more specifically, ferrite particles). In order to achieve high quality image formation over an extended period of time, magnetic carrier particles including carrier cores and resin layers coating the carrier cores are preferably used. In order to ensure that the carrier is capable of sufficiently charging the toner over a long period of time, it is preferable that each resin layer completely covers a surface of a corresponding one of the carrier cores (that is, no surface region of the carrier core is exposed from the resin layer). In order that carrier particles are magnetic, carrier cores thereof may be formed from a magnetic material (for example, ferromagnetic material such as ferrite) or formed from a resin in which magnetic particles are dispersed. Alternatively, magnetic particles may be dispersed in resin layers coating carrier cores. The resin layers are formed from for example at least one resin selected from the group consisting of fluororesins (specific examples include PFA and FEP), polyimide-imide resins, silicone resins, urethane resins, epoxy resins, and phenolic resins. Preferably, the amount of the toner in the two-component developer is at least 5 parts by mass and no greater than 15 parts by mass relative to 100 parts by mass of the carrier in order to achieve high quality image formation. Preferably, the carrier has a number average primary particle diameter of at least 20 μm and no greater than 120 μm. Note that a positively chargeable toner included in a two-component developer is positively charged by friction with a carrier therein.

The toner according to the present embodiment can for example be used in image formation in an electrophotographic apparatus (image forming apparatus). The following describes an example of image forming methods that are performed by electrophotographic apparatuses.

First, an image forming section (for example, a charger and a light exposure device) of an electrophotographic apparatus forms an electrostatic latent image on a photosensitive member (for example, on a surface of a photosensitive drum) based on image data. Next, a developing device (specifically, a developing device having a toner-containing developer loaded therein) of the electrophotographic apparatus supplies the toner to the photosensitive member to develop the electrostatic latent image formed on the photosensitive member. The toner is charged by friction with the carrier, a development sleeve, or a blade in the developing device before being supplied to the photosensitive member. For example, a positively chargeable toner is positively charged. In the developing step, the toner (specifically, charged toner) on the development sleeve (for example, a surface of a development roller in the developing device) disposed in the vicinity of the photosensitive member is supplied to the photosensitive member and caused to adhere to an irradiated portion of the electrostatic latent image on the photosensitive member, so that a toner image is formed on the photosensitive member. Toner in an amount corresponding to the amount of the toner consumed in the developing step is supplied to the developing device from a toner container containing toner for replenishment use.

Subsequently, in a transfer step, a transfer device of the electrophotographic apparatus transfers the toner image on the photosensitive member onto an intermediate transfer member (for example, a transfer belt), and then further transfers the toner image on the intermediate transfer member onto a recording medium (for example, paper). Thereafter, a fixing device (fixing method: nip fixing with a heating roller and a pressure roller) of the electrophotographic apparatus fixes the toner to the recording medium by applying heat and pressure to the toner. As a result, an image is formed on the recording medium. A full-color image can for example be formed by superimposing toner images of four different colors: black, yellow, magenta, and cyan. After the transfer step, toner left on the photosensitive member is removed by a cleaning member (for example, a cleaning blade). A direct transfer process may alternatively be employed, which involves direct transfer of the toner image on the photosensitive member to the recording medium without the use of the intermediate transfer member. Also, belt fixing may alternatively be employed to fix the toner.

The toner according to the present embodiment is an electrostatic latent image developing toner having the following basic features.

(Basic Features of Toner)

The electrostatic latent image developing toner includes toner particles each including a toner mother particle and an external additive adhering to a surface of the toner mother particle. The toner mother particle includes a composite core and a shell layer covering a surface of the composite core. The composite core is a composite of a toner core, organic particles, and polyhedral magnetic particles. The organic particles each contain a releasing agent and adhere to a surface of the toner core. The magnetic particles include magnetic particles adhering to the surface of the toner core and magnetic particles adhering to surfaces of the organic particles. An amount of the magnetic particles is at least 0.5 parts by mass and no greater than 2.0 parts by mass relative to 100 parts by mass of the toner cores. In a cross-sectional image of each toner particle, an area of protruding portions of the respective magnetic particles accounts for at least 10% and no greater than 75% of an overall area of the magnetic particles. The protruding portions are defined as portions each protruding from the shell layer. The percentage accounted for by the area of the protruding portions of the magnetic particles, which are portions protruding from the shell layer, out of the overall area of the magnetic particles in a cross-sectional image of each toner particle may be referred to below as a "magnetic particle protrusion amount". The magnetic particle protrusion amount is measured according to the same method as that employed in Examples described below or an alternative thereof.

In a situation in which the toner core contains an excessively large amount of a releasing agent or a releasing agent is contained in the shell layer (within the film), the releasing agent tends to precipitate onto a surface of the toner particle in a high temperature and high humidity environment, and as a consequence, adhesiveness of the toner tends to increase and/or the toner tends to become difficult to charge. Increased adhesiveness of the toner tends to cause a phenomenon in which the toner particles stick to the carrier (i.e., carrier contamination). Insufficient chargeability of the toner tends to cause scattering of the toner within the developing device, which may reduce image quality of a resultant image.

In the toner having the above-described basic features, the releasing agent is present in the form of particles (specifically, in the form of the organic particles) on the surface of each toner core. The organic particles can be kept in the form of particles until the toner is fixed. When the toner is fixed, on the other hand, the organic particles can be readily fractured by application of heat and pressure to the organic particles. The releasing agent in the organic particles can be supplied to the surface of the toner core through the organic particles being fractured. Thus, it is possible to improve releasability of the toner without increasing the amount of the releasing agent in the toner cores. It is also possible to inhibit precipitation of the releasing agent onto the surfaces of the toner particles in a high temperature and high humidity environment, and thus easily ensure sufficient chargeability of the toner. Furthermore, as a result of the toner having improved releasability, hot offset is inhibited. It is therefore possible to easily ensure a sufficient fixing operation window (fixing OW) of the toner. The fixing OW is defined as a width of fixing temperature range in which offset (cold offset and hot offset) of the toner does not occur.

A toner including toner cores containing a crystalline polyester resin tends to have reduced elasticity. The fixing OW of the toner having reduced elasticity tends to be narrow. However, the toner can have improved elasticity as long as the toner has the above-described basic features. It is therefore possible to easily ensure that the toner has sufficient elasticity and consequently the toner has sufficient fixing OW, even if the toner cores of the toner contain a crystalline polyester resin.

In the toner having the above-described basic features, the organic particles are present at the interfaces between the toner cores and the shell layers. The organic particles tend to make the shell layers distort to create weak regions in places (regions that can be fractured easily) in the shell layers. In a situation in which the shell layers have regions that can be fractured easily, sufficient low-temperature fixability of the toner can be easily ensured even if a resin contained in the shell layers has a relatively high glass transition point.

In the toner having the above-described basic features, the releasing agent can be supplied to the surfaces of the toner cores from the organic particles present at the interfaces between the toner cores and the shell layers. Thus, it is possible to reduce the amount of the releasing agent to be contained in the toner cores. For example, the amount of the releasing agent in the toner cores may be at least 0.5 parts by mass and no greater than 2.5 parts by mass relative to 100 parts by mass of a binder resin in the toner cores. Alternatively, the toner cores may contain no releasing agent so long as sufficient releasability of the toner can be ensured.

In the toner having the above-described basic features and including toner cores containing a releasing agent, the releasing agent in the toner cores and the releasing agent in the organic particles may be the same or different. In order for the toner to have stable properties (more specifically, in order to inhibit change in properties of the toner due to an environmental change or passage of time, for example), the releasing agent in the toner cores and the releasing agent in the organic particles are preferably the same.

However, the present inventor found that the organic particles present at the interfaces between the toner cores and the shell layers facilitate detachment of an external additive adhering to the surfaces of the toner mother particles. The detached external additive may contaminate the inside of the apparatus. The detached external additive may also stick to the surface of the photosensitive drum to lead to a reduction in image quality.

In order to solve the above-described problems, the present inventor contemplated including an appropriate amount (specifically, at least 0.5 parts by mass and no greater than 2.0 parts by mass relative to 100 parts by mass of the toner cores) of polyhedral magnetic particles at the interfaces between the toner cores and the shell layers in addition to the organic particles, and polishing the surface of the photosensitive drum using the magnetic particles (see "Basic Features of Toner" above). This is because the external additive sticking to the surface of the photosensitive drum can be removed by polishing the surface of the photosensitive drum. In general, magnetic particles are hard. The polyhedral magnetic particles therefore are highly abrasive. Spherical magnetic particles are less abrasive as having no edges (see Toner TB-1 described below).

The magnetic particles are covered by the shell layers to be kept from being detached from the composite cores. However, if the magnetic particles are completely covered by the shell layers, the magnetic particles fail to polish the surface of the photosensitive drum. The toner having the above-described basic features has a magnetic particle protrusion amount of at least 10% and no greater than 75%. As a result of the magnetic particles partially protruding from the shell layers, it is possible to ensure that the toner particles have sufficient polishing characteristics. However, a too large magnetic particle protrusion amount allows the magnetic particles to be detached from the composite cores easily. An appropriately large magnetic particle protrusion amount can be achieved by causing an appropriate amount of magnetic particles to adhere to the surfaces of the organic particles. In order to ensure that the toner particles have sufficient polishing characteristics while preventing detachment of the magnetic particles from the composite cores, it is particularly preferable that the magnetic particle protrusion amount is at least 30% and no greater than 45%.

Figure 2:
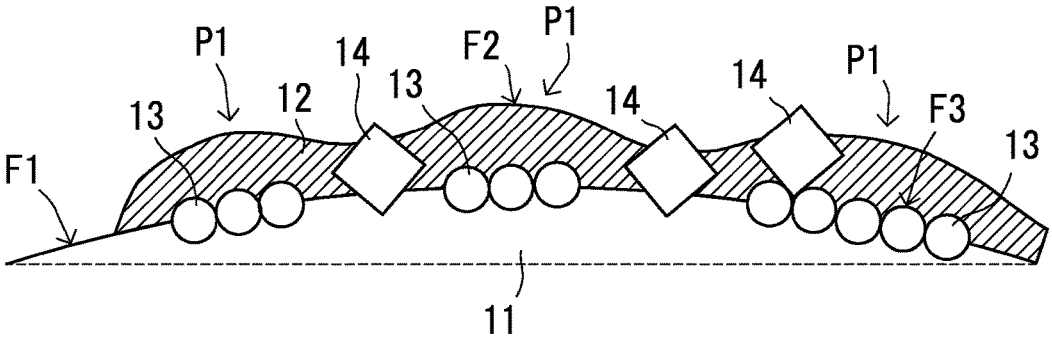
FIG. 2 is an enlarged view of a portion of a surface of the toner mother particle illustrated in FIG. 1.
Figure 3:
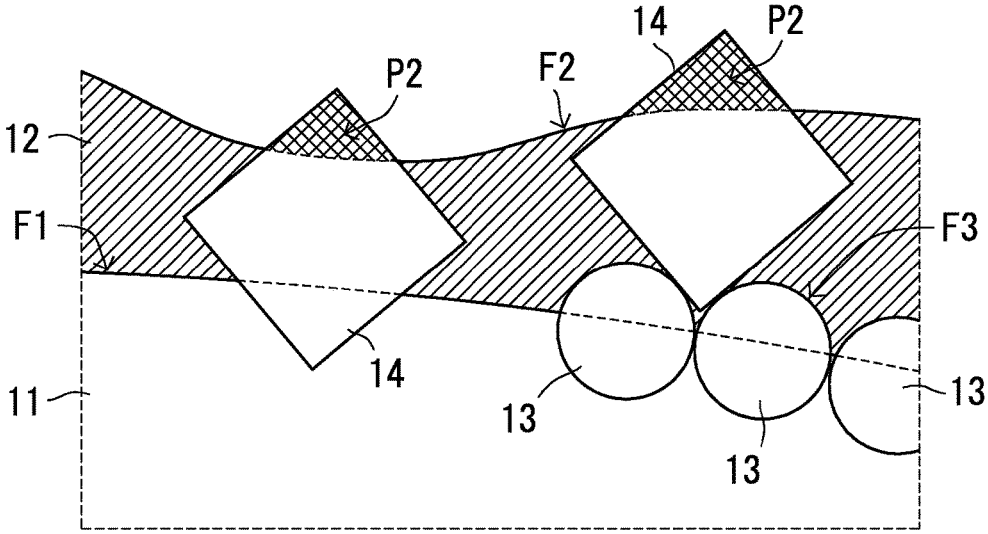
FIG. 3 is an enlarged view of magnetic particles illustrated in FIG. 2.

The following describes an example of the toner particles included in the toner having the above-described basic features with reference to FIGS. 1 to 6. FIGS. 2 and 3 are each an enlarged view of a surface of a toner mother particle. FIGS. 2 and 3 show only the toner mother particle without showing the external additive.

A toner particle 10 illustrated in FIG. 1 includes a toner mother particle 10*a* and an external additive (external additive particles 15). The toner mother particle 10*a* includes a toner core 11 and a shell layer 12 disposed over a surface of the toner core 11. The shell layer 12 is a resin film. The shell layer 12 partially covers the surface of the toner core 11. The external additive particles 15 are for example silica particles. The external additive particles 15 adhere to a surface of the toner mother particle 10*a*. The external additive particles 15 are present both on a surface F1 of the toner core 11 and on a surface F2 of the shell layer 12.

Organic particles 13 and magnetic particles 14 adhere to the surface F1 of the toner core 11 as illustrated in FIG. 2. The magnetic particles 14 have a polyhedral (specific examples include hexahedral, octahedral, and dodecahedral) profile. The magnetic particles 14 are for example iron oxide particles. The organic particles 13 for example have a spherical shape. The organic particles 13 may have any particulate shape. That is, the organic particles 13 may have a hemispherical shape, an ellipsoidal shape, a semi-ellipsoidal shape, a polyhedral (for example, octahedral) shape, or any other irregular shapes.

The toner particle 10 includes the magnetic particles 14 adhering to surfaces F3 of the organic particles 13 in addition to the magnetic particles 14 adhering to the surface F1 of the toner core 11. The magnetic particles 14 can be caused to adhere both to the surface F1 of the toner core 11 and to the surfaces F3 of the organic particles 13 by adding the organic particles 13 to the surface F1 of the toner core 11, and then further adding the magnetic particles 14.

A protrusion amount of the magnetic particles 14 is at least 10% and no greater than 75%. FIG. 3 is an enlarged view of the magnetic particles 14. In FIG. 3, a protrusion P2 is equivalent to a protruding portion of a magnetic particle 14, which is a portion protruding from the shell layer 12. The protrusion amount of the magnetic particles 14 can be determined from a cross-sectional image of the toner particle. The protrusion amount (unit: %) of each magnetic particle 14 is represented by the following formula: "protrusion amount of magnetic particle 14=100×(area of protrusion P2)/(overall area of magnetic particle 14)". The magnetic particle protrusion amount can be measured by analyzing a transmission electron microscope (TEM) image of a cross-section of a toner particle using commercially available image analysis software (for example, "WinROOF", product of Mitani Corporation). A magnetic particle of which at least a portion is covered with the shell layer is used as a measurement target. A magnetic particle not covered with the shell layer at all and a magnetic particle detached from the toner mother particle are excluded as measurement targets.

The following continues the description with reference mainly to FIG. 2. The organic particles 13 and the magnetic particles 14 are present at an interface between the toner core 11 and the shell layer 12. A composite of the toner core 11, the organic particles 13, and the magnetic particles 14 is equivalent to a composite core. The shell layer 12 is a resin film having a shape along the surface of the underlying toner core 11 and the surfaces of the underlying organic particles 13. The surface of the toner mother particle 10*a* has projections and recesses according to presence and absence of the organic particles 13 on the surface F1 of the toner core 11. The surface of the shell layer 12 has projections P1 corresponding to the organic particles 13. More specifically, regions of the surface of the shell layer 12 that have the organic particles 13 thereunder are raised compared to regions that do not have any organic particles 13 thereunder. The projections and recesses formed on the surface of the toner mother particle 10*a* are expected to facilitate detachment of the external additive. However, distortion of the shell layer 12 tends to form fracture points, which increase low-temperature fixability of the toner.

Figure 4:
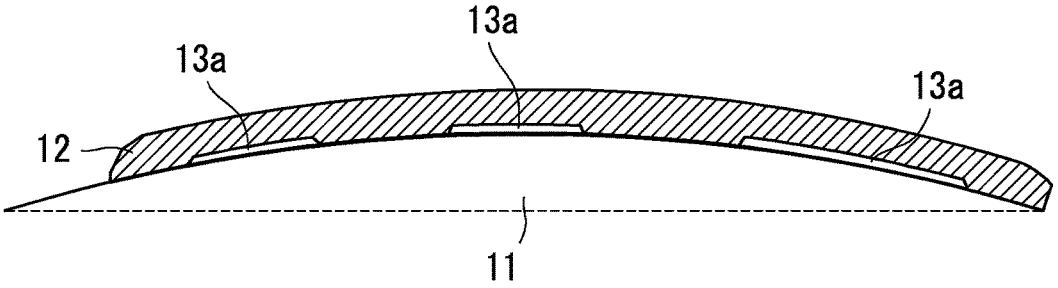
FIG. 4 is an enlarged view of a portion of a surface of a toner mother particle of a toner in which a releasing agent is present in the form of a film on a surface of each toner core.
Figure 5:
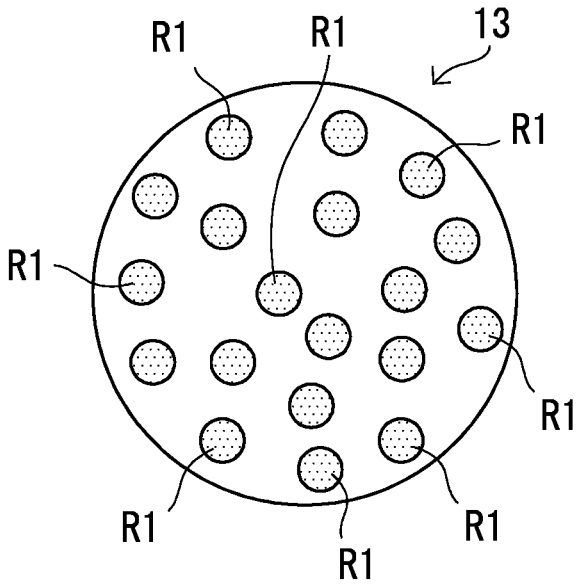
FIG. 5 is a diagram illustrating a first example of a manner in which a releasing agent is dispersed in organic particles that are used in the electrostatic latent image developing toner according to the embodiment of the present disclosure.
Figure 6:
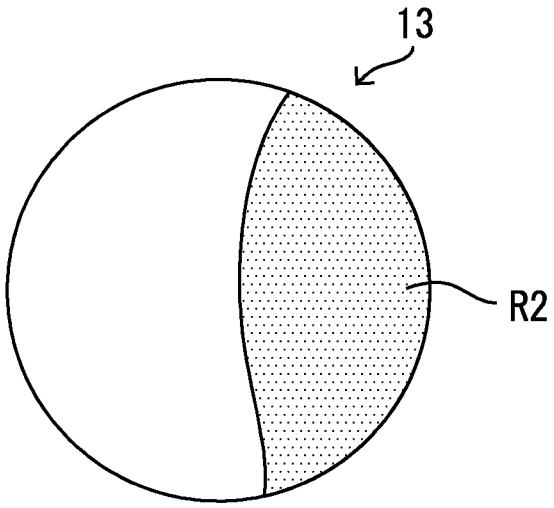
FIG. 6 is a diagram illustrating a second example of a manner in which a releasing agent is dispersed in organic particles that are used in the electrostatic latent image developing toner according to the embodiment of the present disclosure.

For comparison, FIG. 4 illustrates a toner in which a releasing agent is present in the form of a film (i.e., not in the form of particles) on a surface of each toner core. In the example illustrated in FIG. 4, resin films 13*a* contain the releasing agent. The surface of the shell layer 12 does not have projections. It is thought that no definite fracture points (regions that can be fractured easily) are formed in the shell layers of the toner illustrated in FIG. 4. It is therefore difficult to ensure sufficient low-temperature fixability of the toner in a situation in which a resin forming the shell layers has a high glass transition point. Furthermore, in a situation in which the resin is in the form of a film after having melted, the releasing agent in the resin may precipitate onto surfaces of toner particles, and as a consequence, adhesiveness of the toner may increase and/or the toner may become difficult to charge.

In each of the organic particles 13 illustrated in FIG. 2, the releasing agent may be dispersed in any manner. The releasing agent may be dispersed throughout the organic particle 13 as indicated by regions R1 in FIG. 5 or may be dispersed only in a portion of the organic particle 13 as indicated by a region R2 in FIG. 6. The regions R1 in FIG. 5 and the region R2 in FIG. 6 indicate regions of the organic particle 13 in which the releasing agent is present.

According to the above-described basic features, it is particularly preferable that the shell layers have a thickness of at least 20 nm and no greater than 70 nm, the organic particles have a number average primary particle diameter of at least 80 nm and no greater than 150 nm, and the magnetic particles have a number average primary particle diameter of at least 100 nm and no greater than 120 nm. The toner particles in the toner having such a feature tend to have a preferable surface form.

The thickness of a shell layer can be measured by analyzing a transmission electron microscope (TEM) image of a cross-section of a toner particle using commercially available image analysis software (for example, "WinROOF", product of Mitani Corporation). In a situation in which the thickness of a shell layer is not uniform for a single toner particle, the thickness of the shell layer is measured at each of four locations that are approximately evenly spaced. Specifically, two straight lines that perpendicularly intersect at substantially the center of a cross-section of the toner particle are drawn, and lengths of four segments where the two straight lines intersect with the shell layer are measured. Subsequently, an arithmetic mean of the four measured values is determined to be an evaluation value (thickness of the shell layer) for the toner particle. In a situation in which a boundary between the toner core and the shell layer in the TEM image is unclear, the boundary between the toner core and the shell layer can be clarified by mapping characteristic elements contained in the shell layer in the TEM image using a combination of TEM and electron energy loss spectroscopy (EELS).

It is particularly preferable that the shell layers contain a resin having a glass transition point of at least 50° C. and no greater than 90° C. (also referred to below as a "first resin"), and the organic particles contain a resin having a glass transition point of at least 90° C. and no greater than 110° C. (also referred to below as a "second resin"). As a result of the resin (second resin) contained in the organic particles having a sufficiently high glass transition point, the organic particles are prevented from melting before the toner is fixed, and thus the releasing agent is easily kept in the organic particles until the toner is fixed. It is therefore possible to inhibit precipitation of the releasing agent onto the surfaces of the toner particles in a high temperature and high humidity environment. At the same time, as a result of the resin (second resin) contained in the organic particles having a not too high glass transition point, the organic particles can be readily fractured by application of heat and pressure to the organic particles when the toner is fixed. As a result of the resin (first resin) contained in the shell layers having a suitable glass transition point, a preferable surface form of the toner particles is readily achieved, and thus a toner excellent in all of heat-resistant preservability, fixability, and releasability is easily obtained.

Particularly preferably, the first resin contained in the shell layers is a polymer of monomers (resin raw materials) including at least one styrene-based monomer, at least one (meth)acrylic acid ester, and acrylic acid. Particularly preferably, the second resin contained in the organic particles is a polymer of monomers (resin raw materials) including at least one styrene-based monomer, at least one (meth)acrylic acid ester, and acrylic acid. Particularly preferably, the releasing agent contained in the organic particles is at least one releasing agent selected from the group consisting of ester waxes and hydrocarbon waxes. A toner excellent in all of heat-resistant preservability, fixability, chargeability, and releasability is easily obtained by appropriately combining these preferable materials.

Particularly preferably, according to the above-described basic features, each shell layer is a resin film having a shape along the surface of the underlying toner core and the surfaces of the underlying organic particles, the surface of each toner mother particle has projections and recesses according to presence and absence of the organic particles on the surface of the toner core, the amount of the organic particles is at least 0.5 parts by mass and no greater than 30 parts by mass relative to 100 parts by mass of the toner cores, the amount of the releasing agent in the organic particles is at least 1% by mass and no greater than 30% by mass relative to overall mass of the organic particles (i.e., total mass of all components of the organic particles), no magnetic powder is present inside each toner core, and each shell layer contains no releasing agent inside the resin film. A toner excellent in all of heat-resistant preservability, fixability, chargeability, and releasability is easily obtained by appropriately combining these components.

In order to achieve both heat-resistant preservability and low-temperature fixability of the toner, each of the shell layers preferably covers at least 50% and no greater than 90% of the surface area of the corresponding toner core, and particularly preferably covers at least 70% and no greater than 80% of the surface area of the corresponding toner core. The coverage ratio (by area) by a shell layer can for example be measured by analyzing an image of a toner particle (dyed toner particle) captured using a field emission scanning electron microscope ("JSM-7600F", product of JEOL Ltd.). A covered region of the surface of a toner core can be distinguished from a non-covered region (uncovered region) for example by a difference in brightness value. The protruding portion of each magnetic particle, which is a portion protruding from the shell layer, is equivalent to an uncovered region.

Typically, toner cores are broadly classified as being pulverized cores (referred to also as pulverized toners) and as being polymerized cores (referred to also as chemical toners). Toner cores obtained by a pulverization method are classified as the pulverized cores and toner cores obtained by an aggregation method are classified as the polymerized cores. The toner cores in the toner having the above-described basic features are preferably pulverized cores containing a polyester resin. In order to achieve both heat-resistant preservability and low-temperature fixability of the toner, it is particularly preferable that the toner cores contain at least one crystalline polyester resin and at least one non-crystalline polyester resin that are melt-kneaded.

In order to achieve both heat-resistant preservability and low-temperature fixability of the toner, the toner preferably has a Tg of at least 30° C. and no greater than 50° C. In order to achieve both heat-resistant preservability and low-temperature fixability of the toner, the toner preferably has a softening point (Tm) of at least 70° C. and no greater than 100° C.

In order to inhibit aggregation of the toner cores in a shell layer formation process, the toner cores preferably have a triboelectric charge with a standard carrier of less than 0 μC/g, and more preferably no greater than −10 μC/g. The triboelectric charge with a standard carrier is measured according to the same method as that employed in Examples described below or an alternative thereof.

In order to inhibit aggregation of the toner cores in the shell layer formation process, the toner cores preferably have a zeta potential at pH 4 of less than 0 mV, and more preferably no greater than −10 mV. The zeta potential at pH 4 is measured according to the same method as that employed in Examples described below or an alternative thereof.

In order to obtain a toner suitable for image formation, the toner preferably includes the toner particles defined by the above-described basic features in a proportion of at least 70% by number, more preferably in a proportion of at least 90% by number, and still more preferably in a proportion of 100% by number.

In order to obtain a toner suitable for image formation, the toner cores preferably have a volume median diameter ($D_{50}$) of at least 4 μm and no greater than 9 μm.

The following describes a preferable example of a composition of the toner particles.

The toner cores contain a binder resin. The toner cores may contain an internal additive (for example, at least one of a releasing agent, a colorant, a charge control agent, and a magnetic powder) as necessary in addition to the binder resin. The shell layers are substantially composed of a resin. Both heat-resistant preservability and low-temperature fixability of the toner can be achieved by covering each toner core that melts at a low temperature with a shell layer (resin film) excellent in heat resistance. An additive may be dispersed in the resin forming the shell layers. Each shell layer may cover the surface of the corresponding composite core entirely or partially.

The internal additive is dispersed in the binder resin, which is a main component of the toner cores. In such a state, the internal additive is present inside of each toner core. An external additive is externally added to the toner mother particles so as to adhere to the surface of each toner mother particle. Intermediate agents are present at an interface between each toner core and the corresponding shell layer. Both the organic particles and the magnetic particles forming the composite core are intermediate agents.

The shell layers may be grainy or non-grainy films. Resin particles may be used as a material for forming the shell layers. It is thought that non-grainy films are formed as the shell layers in a situation in which the material (resin particles) is caused to completely melt and hardened into a film form. On the other hand, it is thought that films each formed from rows of two-dimensionally arranged resin particles (grainy films) are formed as the shell layers in a situation in which the material (resin particles) is caused not to completely melt and hardened into a film form. The resin particles can be caused to melt and formed into a film for example by causing the resin particles to adhere to the surface of each composite core in a liquid and heating the liquid. Alternatively, the resin particles may be formed into a film by being subjected to heat in a drying process or being subjected to physical impact force in an external additive addition process. Each of the shell layers is not necessarily a continuous layer. Each of the shell layers may be one film or a collection of a plurality of spaced-apart films (islands).

Toner particles including an external additive are composed of toner mother particles and the external additive. The external additive adheres to a surface of each toner mother particle. Each of the toner mother particles of the toner having the above-described basic features includes the composite core (a composite of a toner core, organic particles, and magnetic particles) and the shell layer. Toner mother particles including no external additive are equivalent to toner particles. A material for forming the shell layers is referred to below as a shell material.

The following describes resins suitable for formation of the toner particles.

<Preferable Thermoplastic Resins>

Examples of preferable thermoplastic resins include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Furthermore, copolymers of the resins listed above may be used, which in other words are copolymers obtained through incorporation of a repeating unit into any of the resins listed above (specific examples include styrene-acrylic acid-based resins and styrene-butadiene-based resins).

A thermoplastic resin can be obtained through addition polymerization, copolymerization, or polycondensation of at least one thermoplastic monomer. The thermoplastic monomer is a monomer that forms a thermoplastic resin through homopolymerization (specific examples include an acrylic acid-based monomer and a styrene-based monomer) or a monomer that forms a thermoplastic resin through polycondensation (for example, a combination of a polyhydric alcohol and a polybasic carboxylic acid that forms a polyester resin through polycondensation).

A styrene-acrylic acid-based resin is a copolymer of monomers (resin raw materials) including at least one styrene-based monomer and at least one acrylic acid-based monomer. Styrene-based monomers and acrylic acid-based monomers listed below can for example be preferably used for synthesis of a styrene-acrylic acid-based resin. A carboxyl group can be introduced into a styrene-acrylic acid-based resin by using an acrylic acid-based monomer substituted by a carboxyl group. A hydroxyl group can be introduced into a styrene-acrylic acid-based resin by using a monomer substituted by a hydroxyl group (specific examples include p-hydroxystyrene, m-hydroxy styrene, and hydroxyalkyl (meth)acrylates).

Examples of preferable styrene-based monomers include styrene, alkylstyrenes (specific examples include α-methylstyrene, p-ethylstyrene, and 4-tert-butylstyrene), p-hydroxy styrene, m-hydroxy styrene, α-chlorostyrene, o-chlorostyrene, m-chlorostyrene, and p-chlorostyrene.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

A polyester resin is obtained through polycondensation of at least one polyhydric alcohol and at least one polybasic carboxylic acid. Examples of alcohols that can be preferably used in synthesis of the polyester resin include dihydric alcohols (specific examples include diols and bisphenols) and tri- or higher-hydric alcohols shown below. Examples of carboxylic acids that can be preferably used in synthesis of the polyester resin include di-, tri-, and higher-basic carboxylic acids shown below.

Examples of preferable diols include ethylene glycol, diethylene glycol, triethylene glycol, 1,2-propanediol, 1,3-propanediol, 1,4-butanediol, neopentyl glycol, 2-butene-1, 4-diol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

[Toner Core]

(Binder Resin)

The binder resin is typically a main component (for example, at least 85% by mass) of the toner cores. Accordingly, properties of the binder resin are thought to have a great influence on overall properties of the toner cores. Properties (specific examples include hydroxyl value, acid value, Tg, and Tm) of the binder resin can be adjusted by using different resins in combination for the binder resin. The toner cores have a higher tendency to be anionic in a situation in which the binder resin has, for example, an ester group, a hydroxyl group, an ether group, an acid group, or a methyl group. The toner cores have a higher tendency to be cationic in a situation in which the binder resin has an amino group.

In order to ensure sufficient fixability of the toner in high speed fixing, the glass transition point (Tg) of the binder resin (a binder resin in the greatest amount by mass in a situation in which the toner cores contain a plurality of binder resins) is preferably at least 30° C. and no greater than 60° C., and more preferably at least 35° C. and no greater than 55° C. In order to ensure sufficient fixability of the toner in high speed fixing, the softening point (Tm) of the binder resin (a binder resin in the greatest amount by mass in a situation in which the toner cores contain a plurality of binder resins) is preferably at least 60° C. and no greater than 150° C., and more preferably at least 70° C. and no greater than 140° C.

In order to achieve both heat-resistant preservability and low-temperature fixability of the toner, the toner cores preferably contain a crystalline polyester resin and a non-crystalline polyester resin. As a result of the toner cores containing a crystalline polyester resin, the toner cores are sharp-melting.

In order to achieve both heat-resistant preservability and low-temperature fixability of the toner, an amount of the crystalline polyester resin contained in the toner cores is preferably at least 1% by mass and no greater than 50% by mass, and more preferably at least 15% by mass and no greater than 25% by mass relative to a total amount of the polyester resins (the crystalline polyester resin and the non-crystalline polyester resin) contained in the toner cores. In a situation in which the total amount of the polyester resins in the toner cores is 100 g, for example, the amount of the crystalline polyester resin in the toner cores is preferably at least 1 g and no greater than 50 g (more preferably, at least 15 g and no greater than 25 g).

In order that the toner cores are suitably sharp-melting, the toner cores preferably contain a crystalline polyester resin having a crystallinity index of at least 0.90 and less than 1.15. The crystallinity index of a resin is equivalent to a ratio (=Tm/Mp) of the softening point (Tm) of the resin to the melting point (Mp) of the resin. Mp of a non-crystalline polyester resin is often indeterminable. Mp and Tm of a resin is each measured according to the same method as that employed in Examples described below or an alternative thereof. The crystallinity index of a crystalline polyester resin can be adjusted by changing a material (for example, either or both of an alcohol and a carboxylic acid) to be used in synthesis of the crystalline polyester resin or an amount of use of the material. The toner cores may contain only one crystalline polyester resin, or two or more crystalline polyester resins.

In order to achieve both heat-resistant preservability and low-temperature fixability of the toner, it is particularly preferable that the toner cores contain a crystalline polyester resin having a melting point (Mp) of at least 50° C. and no greater than 100° C.

In order to ensure sufficient crystallinity of the crystalline polyester resin, the crystalline polyester resin preferably contains, as an alcohol component, an aliphatic diol having a carbon number of at least 2 and no greater than 8, and more preferably an α,ω-alkanediol having a carbon number of at least 2 and no greater than 8 (specific examples include 1,6-hexanediol). Furthermore, in order to ensure sufficient crystallinity of the crystalline polyester resin, an alcohol component (a single component) that makes up the largest proportion of all alcohol component(s) of the crystalline polyester resin preferably accounts for at least 70% by mole, more preferably at least 90% by mole, and particularly preferably 100% by mole. In order to ensure sufficient crystallinity of the crystalline polyester resin, an aliphatic diol having a carbon number of at least 2 and no greater than 8 preferably accounts for at least 80% by mole, and more preferably at least 90% by mole of all the alcohol component (s) of the crystalline polyester resin.

In order to ensure sufficient crystallinity of the crystalline polyester resin, the crystalline polyester resin preferably contains, as an acid component, an aliphatic dicarboxylic acid having a carbon number of at least 4 and no greater than 16, and more preferably an α,ω-alkane dicarboxylic acid having a carbon number of at least 4 and no greater than 16 (specific examples include 1,10-decanedicarboxylic acid having a carbon number of 12). Furthermore, in order to ensure sufficient crystallinity of the crystalline polyester resin, an acid component (a single component) that makes up the largest proportion of all acid component(s) of the crystalline polyester resin preferably accounts for at least 70% by mole, more preferably at least 90% by mole, and particularly preferably 100% by mole of all the acid component(s). In order to ensure sufficient crystallinity of the crystalline polyester resin, an aliphatic dicarboxylic acid having a carbon number of at least 4 and no greater than 16 preferably accounts for at least 80% by mole, and more preferably 90% by mole of all the acid component(s) of the crystalline polyester resin.

In order to achieve suitable compatibility between the crystalline polyester resin and the non-crystalline polyester resin in the toner cores, the toner cores preferably contain, as the non-crystalline polyester resin, a copolymer of monomers (resin raw materials) including at least one bisphenol (specific examples include bisphenol A ethylene oxide adduct and bisphenol A propylene oxide adduct), at least one dibasic carboxylic acid (specific examples include fumaric acid), and at least one tribasic carboxylic acid (specific examples include trimellitic acid). The non-crystalline polyester resin contained in the toner cores preferably has an acid value of at least 5 mgKOH/g and no greater than 30 mgKOH/g and a hydroxyl value of at least 15 mgKOH/g and no greater than 80 mgKOH/g. In order to ensure sufficient fixability of the toner, the toner cores preferably contain a non-crystalline polyester resin having a mass average molecular weight (Mw) of at least 10,000 and no greater than 50,000 and a molecular weight distribution (a ratio Mw/Mn of mass average molecular weight (Mw) to number average molecular weight (Mn)) of at least 8 and no greater than 50. In a situation in which Mw or the molecular weight distribution (Mw/Mn) of the non-crystalline polyester resin is excessively large, hot offset is likely to occur. In a situation in which Mw or the molecular weight distribution (Mw/Mn) of the non-crystalline polyester resin is excessively small, it is difficult to reliably fix the toner at a low temperature.

The toner cores may contain, as the binder resin, a resin other than the polyester resins. Examples of resins that can be preferably used as the binder resin other than the polyester resins include thermoplastic resins such as styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyamide resins, and urethane resins. Also, copolymers of the above resins, which in other words are copolymers obtained by incorporation of a repeating unit into any of the above resins (specific examples include styrene-acrylic acid-based resins and styrene-butadiene-based resins), can be preferably used as the binder resin.

(Colorant)

The toner cores may contain a colorant. A known pigment or dye matching a color of the toner can be used as the colorant. Preferably, an amount of the colorant is at least 1 part by mass and no greater than 20 parts by mass relative to 100 parts by mass of the binder resin.

The toner cores may contain a black colorant. An example of the black colorant is carbon black. Alternatively, the black colorant may be a colorant that is adjusted to a black color using a yellow colorant, a magenta colorant, and a cyan colorant. A magnetic powder described further below may be used as the black colorant.

The toner cores may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C. I. Pigment Blue (1, 7, 15, 15:1, 15:2, 15:3, 15:4, 60, 62, or 66), Phthalocyanine Blue, C. I. Vat Blue, and C. I. Acid Blue.

(Releasing Agent)

The toner cores may contain a releasing agent. The releasing agent is for example used in order to improve fixability or offset resistance of the toner.

Examples of releasing agents that can be preferably used in the toner cores include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum; waxes having a fatty acid ester as major component such as montanic acid ester wax and castor wax; and waxes in which a part or all of a fatty acid ester has been deoxidized such as deoxidized carnauba wax. Particularly preferably, a synthetic ester wax is used as the releasing agent in the toner cores. One releasing agent may be used independently, or two or more releasing agents may be used in combination.

(Charge Control Agent)

The toner cores may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent (specific examples include organic metal complexes and chelate compounds). The cationic strength of the toner cores can be increased through the toner cores containing a positively chargeable charge control agent (specific examples include pyridine, nigrosine, and quaternary ammonium salts). However, the toner cores do not need to contain a charge control agent as long as sufficient chargeability of the toner is ensured.

[Intermediate Agent: Organic Particles]

In the toner having the above-describe basic features, organic particles adhere to the surfaces of the toner cores. The organic particles contain a releasing agent and a resin.

The resin in the organic particles is preferably any of the "preferable thermoplastic resins" listed above, more preferably at least one resin selected from the group consisting of acrylic acid-based resins, polyvinyl alcohols, urethane resins, polyester resins, and copolymers of the aforementioned resins (specific examples include styrene-acrylic acid-based resins, silicone-acrylic acid-based graft copolymers, and ethylene-vinyl alcohol copolymers), and particularly preferably a styrene-acrylic acid-based resin. Particularly preferably, the styrene-acrylic acid-based resin is a polymer of monomers (resin raw materials) including at least one styrene-based monomer, at least one (meth)acrylic acid ester, and acrylic acid.

The releasing agent in the organic particles is preferably at least one releasing agent selected from the group consisting of ester waxes (more specifically, synthetic ester waxes and natural ester waxes) and hydrocarbon waxes, and particularly preferably a synthetic ester wax. A synthetic ester wax is particularly preferably used as the releasing agent, because the melting point thereof is easily adjustable to within a desired range. A commercially available synthetic ester wax may be used. Alternatively, a synthetic ester wax may be prepared through reaction of an alcohol and a carboxylic acid (or a carboxylic acid halide) in the presence of an acid catalyst. A long-chain fatty acid originated from natural oil may be used as a raw material of the synthetic ester wax. Examples of preferable natural ester waxes include carnauba wax and rice wax.

In order to improve fixability of the toner, the melting point (Mp) of the releasing agent in the organic particles is preferably at least 50° C. and no greater than 100° C.

[Intermediate Agent: Magnetic Powder]

The composite cores of the toner having the above-described basic features include a magnetic powder (magnetic particles). The magnetic particles adhere to both the surfaces of the toner cores and the surfaces of the organic particles. The magnetic particles have a polyhedral (specific examples include hexahedral, octahedral, and dodecahedral) profile. Preferably, the magnetic particles have a roundness (a number average of primary particles) of at least 0.75 and no greater than 0.96. Examples of materials of the magnetic powder that can be preferably used include ferromagnetic metals (specific examples include iron, cobalt, and nickel), alloys thereof, ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

In order to inhibit elution of metal ions (for example, iron ions) from the magnetic powder, it is preferable to treat the magnetic powder (more specifically, surfaces of the magnetic particles included in the magnetic powder) using a surface treatment agent (specific examples include silane coupling agents and titanate coupling agents).

[Shell Layer]

In the toner having the above-described basic features, a shell layer covers the surface of each composite core. The shell layers contain a resin.

The resin in the shell layers is preferably any of the "preferable thermoplastic resins" listed above, more preferably at least one resin selected from the group consisting of acrylic acid-based resins, polyvinyl alcohols, urethane resins, polyester resins, and copolymers of the aforementioned resins (specific examples include styrene-acrylic acid-based resins, silicone-acrylic acid-based graft copolymers, and ethylene-vinyl alcohol copolymers), and particularly preferably a styrene-acrylic acid-based resin. Particularly preferably, the styrene-acrylic acid-based resin is a polymer of monomers (resin raw materials) including at least one styrene-based monomer, at least one (meth)acrylic acid ester, and acrylic acid.

[External Additive]

An external additive (specifically, external additive particles) may be caused to adhere to the surfaces of the toner mother particles. Unlike internal additives, the external additive is not present inside the toner mother particles and is selectively present only on the surfaces of the toner mother particles (i.e., in surface layers of the toner particles). The external additive particles can for example be caused to adhere to the surfaces of the toner mother particles by stirring the toner mother particles and the external additive (particles) together. The toner mother particles and the external additive particles do not chemically react with one another and are physically, not chemically, connected to one another. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

External additive particles are preferably inorganic particles, and particularly preferably silica particles or particles of a metal oxide (specific examples include alumina, titanium oxide, magnesium oxide, zinc oxide, strontium titanate, and barium titanate). However, particles of an organic acid compound such as a fatty acid metal salt (specific examples include zinc stearate) or resin particles may be used as the external additive particles. Alternatively or additionally, composite particles, which are particles of a composite of a plurality of materials, may be used as the external additive particles. One type of external additive particles may be used independently, or two or more types of external additive particles may be used in combination.

In order to allow the external additive to sufficiently exhibit its function while preventing detachment of the external additive particles from the toner particles, an amount of the external additive (in a situation in which plural types of external additive particles are used, a total amount of the external additive particles) is preferably at least 0.5 parts by mass and no greater than 10 parts by mass relative to 100 parts by mass of the toner mother particles.

In order to improve fluidity of the toner, it is preferable to use inorganic particles having a number average primary particle diameter of at least 5 nm and no greater than 30 nm as the external additive particles. In order that the external additive functions as a spacer between the toner particles to improve heat-resistant preservability of the toner, it is preferable to use resin particles having a number average primary particle diameter of at least 50 nm and no greater than 200 nm as the external additive particles.

[Toner Production Method]

In order to produce the toner having the above-described basic features easily and favorably, for example, the toner production method preferably includes a toner core preparatory process, a core external additive addition process, and a shell layer formation process described below.

(Toner Core Preparatory Process)

Preferable examples of methods for forming toner cores include the pulverization method and the aggregation method. Sufficient dispersion of an internal additive in a binder resin can be easily achieved by these methods.

First, in an example of the pulverization method, a binder resin, a colorant, a charge control agent, and a releasing agent are mixed. Subsequently, the resultant mixture is melt-kneaded using a melt-kneading device (for example, a single screw or twin screw extruder). Subsequently, the resultant melt-kneaded product is pulverized, and the resultant pulverized product is classified. Through the above, toner cores are obtained. Typically, the toner cores are formed more easily according to the pulverization method than according to the aggregation method.

First, in an example of the aggregation method, a binder resin, a releasing agent, and a colorant each in the form of fine particles are caused to aggregate in an aqueous medium to form particles having a desired particle diameter. Through the above, aggregated particles containing the binder resin, the releasing agent, and the colorant are formed. Subsequently, the resultant aggregated particles are heated to cause coalescence of the components contained in the aggregated particles. As a result, toner cores having a desired particle diameter are obtained.

(Core External Additive Addition Process)

Organic particles are fixed to surfaces of the toner cores to obtain first composite cores (a composite of the toner cores and the organic particles). Next, polyhedral magnetic particles are fixed to surfaces of the thus obtained first composite cores. The magnetic particles adhere both to the surfaces of the toner cores and to surfaces of the organic particles. Through the above, second composite cores (a composite of the toner cores, the organic particles, and the magnetic particles) are obtained. The second composite cores are equivalent to the composite cores according to the above-described basic features. Each of the thus obtained composite cores includes a toner core, a plurality of organic particles, and a plurality of polyhedral magnetic particles. The organic particles and the polyhedral magnetic particles are stacked on the toner core in the stated order to form a toner mother particle, and the organic particles and the polyhedral magnetic particles are present in a surface layer of the toner mother particle. All of the organic particles are located further toward the toner core than the magnetic particles. That is, no magnetic particles are located further toward the toner core than the organic particles. The toner mother particle includes a stack of the organic particles and the magnetic particles that are stacked on the toner core in the stated order, but does not include a stack of the magnetic particles and the organic particles that are stacked on the toner core in the stated order.

The organic particles are fixed to the surface of each toner core (caused to form a composite with the toner core) for example by mixing the toner cores and the organic particles (for example, thermoplastic resin particles containing a releasing agent) using a mixer (specific examples include an FM mixer produced by Nippon Coke & Engineering Co., Ltd. and a NAUTA MIXER (registered Japanese trademark) produced by Hosokawa Micron Corporation). Stirring the toner cores and the organic particles together causes the organic particles to adhere to the surfaces of the toner cores by physical force (physical connection). As a result, the first composite cores (more specifically, a composite of the toner cores and the organic particles) are obtained.

The magnetic particles are fixed to the surface of each first composite core (caused to form a composite with the first composite core) for example by mixing the first composite cores and the magnetic particles (specifically, octahedral magnetic particles) using a mixer (specific examples include an FM mixer produced by Nippon Coke & Engineering Co., Ltd. and a NAUTA MIXER (registered Japanese trademark) produced by Hosokawa Micron Corporation). Stirring the first composite cores and the magnetic particles together causes the magnetic particles to adhere to the surfaces of the first composite cores by physical force (physical connection). As a result, the second composite cores (more specifically, composite of the toner cores, the organic particles, and the magnetic particles) are obtained.

An FM mixer (product of Nippon Coke & Engineering Co., Ltd.) can for example be used as the mixer. The FM mixer includes a mixing vessel equipped with a temperature control jacket. The FM mixer further includes, in the mixing vessel, a deflector, a temperature sensor, an upper screw, and a lower screw. A material (specific examples include particles and slurries) loaded into the mixing vessel of the FM mixer is mixed through the material being caused to flow in an up-down direction while turning with rotation of the lower screw in the mixing vessel. As a result, a convective flow of the material is generated in the mixing vessel. The upper screw rotates at a high speed to apply shear force to the material. The FM mixer is capable of mixing the material with strong mixing force by applying the shear force to the material.

(Shell Layer Formation Process)

A shell layer is formed on the surface of each second composite core obtained as described above. The following describes a preferable example of methods for forming the shell layers. In order to inhibit dissolution or elution of toner core components (particularly, the binder resin and the releasing agent) during formation of the shell layers, the shell layers are preferably formed in an aqueous medium. The aqueous medium is a medium of which a main component is water (specific examples include pure water and a liquid mixture of water and a polar medium). The aqueous medium may function as a solvent. A solute may be dissolved in the aqueous medium. The aqueous medium may function as a dispersion medium. A dispersoid may be dispersed in the aqueous medium. Examples of polar mediums that can be used in the aqueous medium include alcohols (specific examples include methanol and ethanol). The aqueous medium has a boiling point of approximately 100° C.

First, a weakly acid aqueous medium (for example, having a selected pH in a range of from 3 to 5) is prepared by adding hydrochloric acid to ion exchanged water. Subsequently, a shell material (for example, thermoplastic resin particles containing no releasing agent) is added to the pH adjusted aqueous medium.

Note that an amount of the shell material appropriate to form shell layers having a desired thickness can for example be calculated based on a specific surface area of the second composite cores. Furthermore, a polymerization accelerator may be added to the liquid.

In order that the shell material uniformly adheres to the surface of each second composite core, it is preferable to achieve a high degree of dispersion of the second composite cores in the liquid containing the shell material. In order to achieve a high degree of dispersion of the second composite cores in the liquid, a surfactant may be added to the liquid or the liquid may be stirred using a powerful stirrer (for example, "Hivis Disper Mix", product of PRIMIX Corporation). In a situation in which the second composite cores are anionic, agglomeration of the second composite cores can be prevented by using an anionic surfactant having the same polarity. Examples of surfactants that can be used include sulfate ester salt surfactants, sulfonic acid salt surfactants, phosphate ester salt surfactants, and soaps.

Subsequently, the liquid containing the second composite cores and the shell material is heated under stirring up to a target temperature (for example, a selected temperature in a range of from 45° C. to 95° C.) at a specific rate (for example, a selected rate in a range of from 0.1° C./minute to 3.0° C./minute). Particularly preferably, the target temperature is at least 50° C. and no greater than 80° C. in order that formation of the shell layers proceeds favorably. The temperature of the liquid is maintained at the target temperature under stirring for a predetermined period of time (for example, a selected period of time in a range of from 30 minutes to 4 hours). It is thought that the shell material (resin particles) adheres to the surfaces of the second composite cores and bonding between the second composite cores and the shell material (fixation of the shell layers) proceeds while the liquid is maintained at the high temperature (or while the liquid is being heated). The shell layers are formed through bonding between the second composite cores and the shell material. It is thought that the shell material (resin particles) melts in the liquid through heating and hardens into a film form. The shell layers are formed on the surfaces of the second composite cores in the liquid, and thus a dispersion of toner mother particles is obtained.

As described above, the resin particles are caused to adhere to the surface of each second composite core in the liquid, and then caused to melt (or deform) to form a film through heating of the liquid. Alternatively, the resin particles may be subjected to heat in a drying process or may be subjected to physical impact force in a shell external additive addition process in order to form a film.

Subsequently, the dispersion of the toner mother particles is neutralized using for example sodium hydroxide. Subsequently, the dispersion of the toner mother particles is cooled to for example room temperature (approximately 25° C.). Subsequently, the dispersion of the toner mother particles is filtered using for example a Buchner funnel. Through the above, the toner mother particles are separated from the liquid (solid-liquid separation), and thus a wet cake of the toner mother particles is obtained. Subsequently, for example, dispersing the toner mother particles in water and filtering a resultant dispersion are repeated to wash the toner mother particles. Subsequently, the washed toner mother particles are dried. The toner mother particles are dried using for example a spray dryer, a fluidized bed dryer, a vacuum freeze dryer, or a reduced pressure dryer. Thereafter, an external additive may be added to the toner mother particles (shell external additive addition process) as necessary. In the shell external additive addition process, an external additive (for example, silica particles) is caused to adhere to the surfaces of the toner mother particles by mixing the toner mother particles and the external additive using for example a mixer (specific examples include an FM mixer produced by Nippon Coke & Engineering Co., Ltd.). The shell external additive addition process can be performed at the same time as the drying process by spraying a dispersion of an external additive (for example, silica particles) to the toner mother particles using a spray dryer in the drying process. Through the above, a toner including a number of toner particles is obtained.

The procedures and order of the processes in the above-described toner production method may be altered as appropriate according to desired structure or properties of the toner. For example, for causing a reaction of a material (for example, the shell material) in a liquid, the material may be caused to react in the liquid for a predetermined period of time after the material is added into the liquid, or the material may be caused to react in the liquid while the material is being added into the liquid over a long period of time. Also, the shell material may be added to the liquid as a single addition or may be divided up and added to the liquid as a plurality of additions. The toner may be sifted after the external additive addition process. Note that non-essential processes may be omitted. For example, in a situation in which a commercially available product can be used as is as a material, for example, a process of preparing the material can be omitted by using the commercially available product. For another example, in a situation in which the reaction for forming the shell layers progresses favorably without pH adjustment of the liquid, a process of pH adjustment may be omitted. For another example, in a situation in which an external additive is not necessary, the shell external additive addition process may be omitted. In a situation in which an external additive is not caused to adhere to the surfaces of the toner mother particles (i.e., the shell external additive addition process is omitted), the toner mother particles are equivalent to the toner particles. A prepolymer may be used as necessary instead of a monomer as a material for synthesizing a resin. In order to obtain a specific compound, a salt, an ester, a hydrate, or an anhydride of the compound may be used as a raw material. Preferably, a large number of the toner particles are formed at the same time in order to produce the toner efficiently. Toner particles produced at the same time are thought to have substantially the same structure.

EXAMPLES

The following describes examples of the present disclosure. Table 1 shows toners (positively chargeable electrostatic latent image developing toners) TA-1 to TA-9 and TB-1 to TB-6 according to Examples and Comparative Examples. Table 2 shows magnetic powders M-1 and M-2 used in the production of the toners shown in Table 1.

TABLE 1

| | Core external additive addition | | | Toner particle surface form | |
|---|---|---|---|---|---|
| Toner | Magnetic powder | Amount [parts by mass] | Mixing time [minutes] | Shell layer thickness [nm] | Magnetic particle protrusion amount [%] |
| TA-1 | M-1 | 1.0 | 2.0 | 47 | 45 |
| TA-2 | M-1 | 1.0 | 2.0 | 20 | 60 |
| TA-3 | M-1 | 1.0 | 2.0 | 70 | 30 |
| TA-4 | M-1 | 0.5 | 1.8 | 47 | 45 |
| TA-5 | M-1 | 2.0 | 2.5 | 47 | 45 |
| TA-6 | M-1 | 1.0 | 5.0 | 47 | 10 |
| TA-7 | M-1 | 1.0 | 1.0 | 47 | 72 |
| TA-8 | M-1 | 1.0 | 2.0 | 10 | 65 |
| TA-9 | M-1 | 1.0 | 2.0 | 80 | 27 |
| TB-1 | M-2 | 1.0 | 2.0 | 47 | 46 |
| TB-2 | M-1 | 0.2 | 1.5 | 47 | 40 |
| TB-3 | M-1 | 2.5 | 3.0 | 48 | 45 |
| TB-4 | M-1 | 1.0 | 7.0 | 46 | 5 |
| TB-5 | M-1 | 1.0 | 0.5 | 46 | 80 |
| TB-6 | None | — | — | 45 | — |

In Table 1, "Amount [parts by mass]" under "Core external additive addition" indicates an amount of each magnetic powder relative to 100 parts by mass of the toner cores.

TABLE 2

| Magnetic powder | Shape | Number average primary particle diameter [nm] |
|---|---|---|
| M-1 | Octahedral | 150 |
| M-2 | Spherical | 140 |

The following describes a production method, evaluation methods, and evaluation results of the toners TA-1 to TA-9 and TB-1 to TB-6 in order. In evaluations in which errors might occur, an evaluation value was calculated by obtaining an appropriate number of measured values and calculating an arithmetic mean of the measured values in order to ensure that any errors were sufficiently small. Glass transition point (Tg), melting point (Mp), softening point (Tm), and molecular weight (Mw and Mn) were measured according to the methods described below.

<Measurement Method of Tg>

A differential scanning calorimeter ("DSC-6220", product of Seiko Instruments Inc.) was used as a measuring device. The glass transition point (Tg) of a sample was determined by plotting a heat absorption curve of the sample using the measuring device. Specifically, approximately 10 mg of a sample (for example, a resin) was placed in an aluminum pan (aluminum container) and the aluminum pan was set on a measurement section of the measuring device. An empty aluminum pan was used as a reference. For plotting the heat absorption curve, a temperature of the measurement section was increased from 25° C., which is a measurement initiation temperature, to 200° C. at a rate of 10° C./minute (RUN 1). Thereafter, the temperature of the measurement section was reduced from 200° C. to 25° C. at a rate of 10° C./minute. Subsequently, the temperature of the measurement section was increased again from 25° C. to 200° C. (RUN 2) at a rate of 10° C./minute. The heat absorption curve (vertical axis: heat flow (DSC signal), horizontal axis: temperature) of the sample was plotted in RUN 2. The glass transition point (Tg) of the sample was read from the plotted heat absorption curve. The glass transition point (Tg) of the sample is a temperature (onset temperature) corresponding to a point of change in specific heat on the heat absorption curve (an intersection point of an extrapolation of a baseline and an extrapolation of an inclined portion of the curve).

<Measurement Method of Mp>

A differential scanning calorimeter ("DSC-6220", product of Seiko Instruments Inc.) was used as a measuring device. The melting point (Mp) of a sample was determined by plotting a heat absorption curve of the sample using the measuring device. Specifically, approximately 15 mg of a sample (for example, a releasing agent or a resin) was placed in an aluminum pan and the aluminum pan was set on a measurement section of the measuring device. An empty aluminum pan was used as a reference. For plotting the heat absorption curve, a temperature of the measurement section was increased from 30° C., which is a measurement initiation temperature, to 170° C. at a rate of 10° C./minute. The heat absorption curve (vertical axis: heat flow (DSC signal), horizontal axis: temperature) of the sample was plotted during the heating. The melting point (Mp) of the sample was read from the plotted heat absorption curve. The melting point (Mp) of the sample is a temperature of a peak corresponding to a maximum of the heat of fusion on the heat absorption curve.

<Measurement Method of Tm>

A sample (for example, a resin) was set in a capillary rheometer ("CFT-500D", product of Shimadzu Corporation) and an S-shaped curve (vertical axis: stroke, horizontal axis: temperature) of the sample was plotted by causing melt-flow of 1 $cm^3$ of the sample under conditions of a die pore diameter of 1 mm, a plunger load of 20 $kg/cm^2$, and a heating rate of 6° C./minute. The softening point (Tm) of the sample was read from the plotted S-shaped curve. The softening point (Tm) of the sample is a temperature on the S-shaped curve corresponding to a stroke value of $(S_1+S_2)/2$, where $S_1$ represents a maximum stroke value and $S_2$ represents a base line stroke value at low temperatures.

<Measurement Method of Molecular Weight>

The molecular weight of a sample (specifically, a THF soluble component thereof) was measured by gel permeation chromatography (GPC). A gel permeation chromatography (GPC) apparatus ("HLC-8220GPC", product of Tosoh Corporation) was used as a measuring device. A polystyrene gel column obtained by combining two columns for organic solvent size exclusion chromatography (SEC) ("TSKgel GMHXL", product of Tosoh Corporation, filler: styrene-based polymer, column size: 7.8 mm (inside diameter)×30 cm (length), filler particle diameter: 9 μm) in series was used. A refractive index (RI) detector was used.

Tetrahydrofuran (THF) was used as a solvent. The sample (resin) was added into the THF to give a concentration of 3.0 mg/mL and left to stand for 1 hour to be dissolved in the THF. The resultant THF solution was filtered using a non-aqueous sample pretreatment filter ("Chromatodisc 25N", product of Kurabo Industries Ltd., filter pore size: 0.45 μm) to obtain a measurement sample (THF solution of the sample).

The column was set within a heat chamber of the measuring device. A temperature of the heat chamber was controlled to 40° C. and the column was stabilized within the heat chamber at 40° C. Subsequently, the solvent (THF) was passed through the column at 40° C. at a flow rate of 1 mL/minute, and approximately 100 μL of the measurement sample (THF solution prepared as described above) was introduced into the column. An elution curve (vertical axis: detection intensity (detection count), horizontal axis: elution time) of the sample solution introduced into the column was plotted. A GPC molecular weight distribution (consequently, number average molecular weight (Mn) and mass average molecular weight (Mw)) of the sample (specifically, a THF soluble component thereof) was determined based on the plotted elution curve and a calibration curve (a graph indicating a relationship between logarithmic value of molecular weight and elution time for standard substances each having a known molecular weight).

The calibration curve was obtained using monodispersed polystyrenes (standard substances). Seven monodispersed polystyrenes (products of Tosoh Corporation) respectively having specific molecular weights ($3.84\times10^6$, $1.09\times10^6$, $3.55\times10^5$, $1.02\times10^5$, $4.39\times10^4$, $9.10\times10^3$, and $2.98\times10^3$) were used as the standard substances.

[Material Preparation]

(Synthesis of Non-Crystalline Polyester Resin)

A reaction vessel having a capacity of 5 L and equipped with a thermometer (thermocouple), a drainage tube, a nitrogen inlet tube, and a stirrer (stirring impeller) was set up in an oil bath and charged with 1,575 g of bisphenol A propylene oxide adduct (BPA-PO), 163 g of bisphenol A ethylene oxide adduct (BPA-EO), 377 g of fumaric acid, and 4 g of a catalyst (dibutyl tin oxide). Subsequently, a nitrogen atmosphere was created in the vessel, and then the internal temperature of the vessel was increased up to 220° C. using the oil bath while the vessel contents were stirred. The vessel contents were then caused to undergo a reaction (specifically, polymerization reaction) for 8 hours under the nitrogen atmosphere at 220° C. while evaporating water produced as a by-product.

Subsequently, the internal pressure of the vessel was reduced, and the vessel contents were caused to further undergo a reaction (specifically, polymerization reaction) for 1 hour under the reduced pressure atmosphere (pressure: approximately 60 mmHg) at 220° C. Thereafter, the internal temperature of the vessel was decreased to 210° C., and then the vessel contents were caused to react under the reduced pressure atmosphere (pressure: approximately 60 mmHg) at 210° C. through addition of 336 g of trimellitic anhydride into the vessel until a reaction product (non-crystalline polyester resin) having the following physical property values was obtained. Thereafter, the vessel contents were taken out of the vessel and cooled. Thus, a non-crystalline polyester resin having a softening point (Tm) of 100° C., a glass transition point (Tg) of 50° C., a mass average molecular weight (Mw) of 30,000, an acid value (AV) of 15 mgKOH/g, and a hydroxyl value (OHV) of 30 mgKOH/g was obtained.

(Synthesis of Crystalline Polyester Resin)

A reaction vessel having a capacity of 5 L and equipped with a thermometer (thermocouple), a drainage tube, a nitrogen inlet tube, and a stirrer (stirring impeller) was set up in an oil bath and charged with 132 g of 1,6-hexanediol, 230 g of 1,10-decanedicarboxylic acid, 0.3 g of 1,4-benzenediol, and 1 g of a catalyst (dibutyl tin oxide). Subsequently, a nitrogen atmosphere was created in the vessel, and then the internal temperature of the vessel was increased up to 200° C. using the oil bath while the vessel contents were stirred. The vessel contents were then caused to undergo a reaction (specifically, polymerization reaction) for 5 hours under the nitrogen atmosphere at 200° C. while evaporating water produced as a by-product.

Subsequently, the internal pressure of the vessel was reduced, and the vessel contents were caused to react under the reduced pressure atmosphere (pressure: approximately 12 mmHg) at 200° C. until a reaction product (crystalline polyester resin) having the following physical property values was obtained. Thereafter, the vessel contents were taken out of the vessel and cooled. Thus, a crystalline polyester resin having a softening point (Tm) of 80° C., a melting point (Mp) of 70° C., a crystallinity index of 1.14, an acid value (AV) of 3.6 mgKOH/g, and a hydroxyl value (OHV) of 18 mgKOH/g was obtained.

(Preparation of Toner Cores)

An FM mixer (product of Nippon Coke & Engineering Co., Ltd.) was used to mix 86 parts by mass of the non-crystalline polyester resin obtained as described above, 15 parts by mass of the crystalline polyester resin obtained as described above, 5 parts by mass of a colorant (carbon black: "MA-100", product of Mitsubishi Chemical Corporation), and 5 parts by mass of a releasing agent (synthetic ester wax: "NISSAN ELECTOL (registered Japanese trademark) WEP-3", product of NOF Corporation).

Subsequently, the resultant mixture was melt-kneaded using a twin screw extruder ("PCM-30", product of Ikegai Corp.). Thereafter, the resultant kneaded product was cooled. After cooling, the kneaded product was pulverized using a mechanical pulverizer ("Turbo Mill", product of FREUND-TURBO CORPORATION). Subsequently, the resultant pulverized product was classified using a classifier ("Elbow Jet EJ-LABO", product of Nittetsu Mining Co., Ltd.). As a result, toner cores having a volume median diameter ($D_{50}$) of 6 μm, a triboelectric charge with a standard carrier of −20 μC/g, and a zeta potential at pH 4 of −30 mV was obtained. The triboelectric charge with a standard carrier and the zeta potential at pH 4 were measured according to methods described below.

<Triboelectric Charge Measurement Method>

A mixer ("TURBULA (registered Japanese trademark) mixer T2F", product of Willy A. Bachofen (WAB) AG) was used to mix 100 parts by mass of a standard carrier N-01 (standard carrier for negatively chargeable toner) provided by The Imaging Society of Japan and 7 parts by mass of a sample (toner cores) at a rotational speed of 96 rpm for 30 minutes. Subsequently, the triboelectric charge of the sample in the resultant mixture was measured using a Q/m meter ("MODEL 210HS-2A", product of TREK, INC.). Specifically, 0.10 g of the mixture (the standard carrier and the sample) was loaded into a measurement cell of the Q/m meter, and only the sample (toner cores) in the loaded mixture was sucked through a sieve (metal mesh) for 10 seconds. The charge (unit: μC/g) of the sample (toner cores) was calculated based on the following expression: "total amount of electricity of sucked sample (unit: μC)/mass of sucked sample (unit: g)".

<Zeta Potential Measurement Method>

A magnetic stirrer was used to mix 0.2 g of the sample (toner cores), 80 g of ion exchanged water, and 20 g of a 1% by mass non-ionic surfactant ("K-85", product of Nippon Shokubai Co., ingredient: polyvinylpyrrolidone). Subsequently, the sample was uniformly dispersed in the liquid to give a dispersion. Subsequently, the resultant dispersion was adjusted to pH 4 through addition of dilute hydrochloric acid thereto to give a dispersion at pH 4. A zeta potential of the sample (toner cores) in the dispersion at 25° C. and pH 4 was measured by electrophoresis (more specifically, laser Doppler electrophoresis) using a zeta potential and particle size distribution analyzer ("Delsa Nano HC", product of Beckman Coulter, Inc.).

(Preparation of Organic Particles A)

(Preparation of Organic Particles A: Preparation of Wax Dispersion)

A high-pressure shear emulsification device ("CLEARMIX (registered Japanese trademark) CLM-2.2S", product of M Technique Co., Ltd.) was charged with 80 parts by mass of ion exchanged water at 80° C., 20 parts by mass of a synthetic ester wax ("NISSAN ELECTOL WEP-3", product of NOF Corporation), sodium dodecylbenzenesulfonate, and poly(oxyethylene) nonyl phenyl ether. Subsequently, the above materials were emulsified using the high-pressure shear emulsification device. As a result, a wax dispersion was obtained, which is a dispersion containing ester wax particles. The ester wax particles in the wax dispersion had a number average primary particle diameter of 420 nm. The number average primary particle diameter was measured using a laser diffraction/scattering particle size distribution analyzer ("LA-950V2", product of HORIBA, Ltd.).

(Preparation of Organic Particles A: Resin Synthesis Process)

A reaction vessel (capacity: 2 L, inside diameter: 120 mm) equipped with a thermometer (thermocouple), a drainage tube, a nitrogen inlet tube, and a stirrer (stirring impeller: three sweptback blades) was set up in an oil bath and charged with 35 parts by mass of the wax dispersion obtained as described above and 328 parts by mass of ion exchanged water. Subsequently, the temperature of the vessel contents was increased up to 80° C. using the oil bath while nitrogen was introduced into the vessel. Thereafter, 6.4 parts by mass of a 2% by mass aqueous hydrogen peroxide solution and 6.4 parts by mass of a 2% by mass aqueous ascorbic acid solution were added into the vessel.

Subsequently, dripping of three types of liquids (a first liquid, a second liquid, and a third liquid) into the vessel was simultaneously started under the nitrogen atmosphere at 80° C. Specifically, 90.0 parts by mass of the first liquid described below was dripped at a constant rate over 5 hours, 25.8 parts by mass of the second liquid described below was dripped at a constant rate over 5 hours, and 72.0 parts by mass of the third liquid described below was dripped at a constant rate over 6 hours. The first liquid was a liquid mixture of styrene, n-butyl acrylate, and acrylic acid (mass ratio: styrene/n-butyl acrylate/acrylic acid=90.1/7.9/2.0). The second liquid was a liquid mixture of 2.7 parts by mass of a 10% by mass aqueous solution of sodium dodecylbenzenesulfonate, 1.1 parts by mass of a 1% by mass aqueous solution of poly(oxyethylene) nonyl phenyl ether, and 22.0 parts by mass of ion exchanged water. The third liquid was a liquid mixture of 36 parts by mass of a 2% by mass aqueous hydrogen peroxide solution and 36 parts by mass of a 2% by mass aqueous ascorbic acid solution.

Subsequently, the vessel contents were kept under the nitrogen atmosphere at 80° C. for 30 minutes, and thus caused to undergo a reaction (specifically, polymerization reaction). Thereafter, the vessel contents were cooled to give a milky white dispersion containing a polymer. Subsequently, the resultant dispersion was subjected to reduced pressure drying to give organic particles A. The thus obtained organic particles A had a glass transition point (Tg) of 101° C., a particle diameter (number average primary particle diameter) of 120 nm, and a mass average molecular weight (Mw) of 73,000. The number average primary particle diameter was measured using a laser diffraction/scattering particle size distribution analyzer ("LA-950V2", product of HORIBA, Ltd.). The Tg was measured by differential scanning calorimetry described above. The Mw (specifically, Mw of a THF soluble component) was measured by GPC described above. The organic particles A contained a releasing agent (synthetic ester wax).

(Preparation of Magnetic Powder M-1)

Into a reaction vessel, 50 L of a 2.0 mol/L aqueous solution of a ferrous sulfate salt containing $Fe^{2+}$, 40.0 L of a 5.0 mol/L aqueous sodium hydroxide solution, and 10 L of a 0.20 mol/L aqueous sodium phosphate solution were added, and the vessel contents were mixed. The mixture in the reaction vessel was heated up to 85° C. to prepare a ferrous salt suspension containing a ferrous hydroxide colloid.

The temperature of the suspension was kept at 85° C. to adjust the suspension to pH 10. Subsequently, an oxidation reaction of the ferrous salt was initiated with air introduced into the suspension at a rate of 20 L/minute. An aqueous phosphoric acid solution was prepared by dissolving 50 g of orthophosphoric acid in 5 L of water. Once a reaction completion rate of the oxidation reaction reached 10%, addition of the aqueous phosphoric acid solution prepared as described above was started. The aqueous phosphoric acid solution was added at a rate of 2.5 L/hour. The oxidation reaction was continued during addition of the aqueous phosphoric acid solution to give a magnetite particle-containing suspension. The oxidation reaction took 120 minutes in total.

Magnetite particles were filtered off from the magnetite particle-containing suspension by a standard method. The thus obtained magnetite particles were washed, dried, and then pulverized to yield a magnetic powder M-1.

(Preparation of Magnetic Powder M-2)

A magnetic powder M-2 was obtained according to the same method as the preparation method of the magnetic powder M-1 in all aspects other than that the prepared ferrous salt suspension containing a ferrous hydroxide colloid was adjusted to pH 6 instead of pH 10 while being kept at 85° C.

(Preparation of Thermoplastic Resin Particles S-1)

A reaction vessel (capacity: 2 L, inside diameter: 120 mm) equipped with a thermometer (thermocouple), a drainage tube, a nitrogen inlet tube, and a stirrer (stirring impeller: three sweptback blades) was set up in an oil bath and charged with 328 parts by mass of ion exchanged water. Subsequently, the temperature of the vessel contents was increased up to 80° C. using the oil bath while nitrogen was introduced into the vessel. Thereafter, 6.4 parts by mass of a 2% by mass aqueous hydrogen peroxide solution and 6.4 parts by mass of a 2% by mass aqueous ascorbic acid solution were added into the vessel.

Subsequently, dripping of three types of liquids (a first liquid, a second liquid, and a third liquid) into the vessel was simultaneously started under the nitrogen atmosphere at 80° C. Specifically, 90.0 parts by mass of the first liquid described below was dripped at a constant rate over 5 hours, 25.8 parts by mass of the second liquid described below was dripped at a constant rate over 5 hours, and 72.0 parts by mass of the third liquid described below was dripped at a constant rate over 6 hours. The first liquid was a liquid mixture of styrene, n-butyl acrylate, and acrylic acid (mass ratio: styrene/n-butyl acrylate/acrylic acid=79.2/18.8/2.0)). The second liquid was a liquid mixture of 2.7 parts by mass of a 10% by mass aqueous solution of sodium dodecylbenzenesulfonate, 1.1 parts by mass of a 1% by mass aqueous solution of poly(oxyethylene) nonyl phenyl ether, and 22.0 parts by mass of ion exchanged water. The third liquid was a liquid mixture of 36 parts by mass of a 2% by mass aqueous hydrogen peroxide solution and 36 parts by mass of a 2% by mass aqueous ascorbic acid solution.

Subsequently, the vessel contents were kept under the nitrogen atmosphere at 80° C. for 30 minutes, and thus caused to undergo a reaction (specifically, polymerization reaction). Thereafter, the vessel contents were cooled to give a milky white dispersion containing a polymer. Subsequently, the resultant dispersion was subjected to reduced pressure drying to give thermoplastic resin particles S-1. The thus obtained thermoplastic resin particles S-1 had a glass transition point (Tg) of 71° C., a particle diameter (number average primary particle diameter) of 108 nm, and a mass average molecular weight (Mw) of 72,000. The number average primary particle diameter was measured using a laser diffraction/scattering particle size distribution analyzer ("LA-950V2", product of HORIBA, Ltd.). The Tg was measured by differential scanning calorimetry described above. The Mw (specifically, Mw of a THF soluble component) was measured by GPC described above.

[Toner Production Method]

Each of the toners TA-1 to TA-9 and TB-1 to TB-5 was produced by performing core external additive addition described below on the toner cores prepared as described above to prepare composite cores, and forming a shell layer on a surface of each composite core. The toner TB-6 was produced by forming a shell layer on a surface of each of the toner cores prepared as described above without performing core external additive addition described below.

(Core External Additive Addition)

An FM mixer ("FM-10B", product of Nippon Coke & Engineering Co., Ltd., upper blade: Y1 blade for high circulation, lower blade: SO blade for high circulation and high pressure) was used to mix 100 parts by mass of the toner cores prepared as described above and 5 parts by mass of the organic particles (the organic particles A prepared as described above) at a frequency of 57 Hz and a jacket temperature of 20° C. for 5 minutes. Thereafter, a magnetic powder of a type (magnetic powder M-1 or M-2 specified for each toner) and in an amount as shown in Table 1 was added into the FM mixer and mixed at a frequency of 57 Hz and a jacket temperature of 20° C. for a period of time as shown in the column titled "Mixing time" in Table 1. For example, in the production of the toner TA-1, 100 parts by mass of the toner cores and 5 parts by mass of the organic particles were mixed for 5 minutes using the FM mixer to prepare composite cores, and then 1.0 part by mass of the magnetic powder M-1 was added into the FM mixer and mixed for 2 minutes.

Through the mixing, the organic particles and the magnetic powder adhered to the surface of each toner core in the stated order. As a result, toner cores (composite cores) each having the organic particles and the magnetic powder adhering to the surface thereof were obtained.

(Shell Layer Formation)

A three-necked flask having a capacity of 1 L and equipped with a thermometer and a stirring impeller was set up in a water bath. Subsequently, 300 mL of ion exchanged water was added into the flask, and the internal temperature of the flask was kept at 30° C. using the water bath. Subsequently, the flask contents were adjusted to pH 4 through addition of dilute hydrochloric acid to the flask.

Subsequently, the thermoplastic resin particles (thermoplastic resin particles S-1 prepared as described above) were added into the flask. An amount of the thermoplastic resin particles S-1 to add was determined so as to give a shell layer thickness specified in Table 1. For example, in the production of the toner TA-1, 10 g of the thermoplastic resin particles S-1 were added. The shell layer thickness tended to increase with an increase in the amount of the thermoplastic resin particles S-1. Subsequently, 300 g of the composite cores prepared as described above (toner cores as for the production of the toner TB-6) were added into the flask, and the flask contents were stirred at a rotational speed of 200 rpm at 30° C. for 1 hour. Subsequently, 300 mL of ion exchanged water was further added into the flask, and the internal temperature of the flask was increased up to 70° C. at a rate of 1° C./minute while the flask contents were stirred at a rotational speed of 100 rpm. Subsequently, the flask contents were stirred for 2 hours at a rotational speed of 100 rpm at 70° C. As a result, a shell layer was formed on the surface of each of the composite cores (toner cores as for the production of the toner TB-6) in the liquid, yielding a dispersion of toner mother particles.

Subsequently, the dispersion of the toner mother particles was adjusted to pH 7 (neutralized) using sodium hydroxide, and the dispersion of the toner mother particles was cooled to room temperature (approximately 25° C.).

(Washing Process)

The dispersion of the toner mother particles obtained as described above was filtered (solid-liquid separation) using a Buchner funnel. As a result, a wet cake of the toner mother particles was obtained. Thereafter, the thus obtained wet cake of the toner mother particles was re-dispersed in ion exchanged water. Furthermore, the dispersing and the filtering were repeated five times to wash the toner mother particles. In the production of the toner TA-1, an amount of filtrate obtained through the washing was 97 parts by mass relative to 100 parts by mass of the toner mother particles (dried toner mother particles) obtained through a drying process described below. Furthermore, in the production of the toner TA-1, the filtrate obtained through the washing had a total organic carbon (TOC) concentration of no greater than 8 mg/L. The TOC concentration was measured using an online TOC analyzer ("TOC-4200", product of Shimadzu Corporation, oxidation method: 680° C. combustion catalyst oxidation, detection method: NDIR method).

(Drying Process)

Subsequently, the washed toner mother particles were dispersed in a 50% by mass aqueous ethanol solution to give a slurry of the toner mother particles. Subsequently, the toner mother particles in the slurry were dried using a continuous type surface modifier ("COATMIZER (registered Japanese trademark)" produced by Freund Corporation) under conditions of a hot air flow temperature of 45° C. and a blower flow rate of 2 $m^3$/minute. As a result, the dried toner mother particles were obtained.

(Shell External Additive Addition)

Subsequently, 100 parts by mass of the toner mother particles obtained as described above and 1.0 part by mass of dry silica particles ("AEROSIL (registered Japanese trademark) REA90", product of Nippon Aerosil Co., Ltd.)

were mixed for 5 minutes using an FM mixer (product of Nippon Coke & Engineering Co., Ltd.) having a capacity of 10 L under conditions of a rotational speed of 3,000 rpm and a jacket temperature of 20° C. Through the above, the external additive adhered to a surface of each toner mother particle. Thereafter, sifting was performed using a 200-mesh sieve (pore size: 75 μm). As a result, a toner (each of the toners TA-1 to TA-9 and TB-1 to TB-6) including a number of toner particles was obtained.

Each of the toners TA-1 to TA-9 and TB-1 to TB-6 was measured for the shell layer thickness and the magnetic particle protrusion amount. Table 1 shows the measurement results. For example, the toner TA-1 had a shell layer thickness of 47 nm and a magnetic particle protrusion amount of 45%. The shell layer thickness and the magnetic particle protrusion amount were respectively measured according to the methods described below.

(Toner Particle Cross-Sectional Image Capture)

With respect to each of the toners TA-1 to TA-9 and TB-1 to TB-6, the toner (measurement target) was dispersed in cold-setting epoxy resin and left to stand for 2 days at an ambient temperature of 40° C. to yield a hardened material. The hardened material was dyed and was then cut using an ultramicrotome ("EM UC6", product of Leica Microsystems) equipped with a diamond knife to obtain a flake sample. Subsequently, a transmission electron microscope (TEM, "JSM-6700F", product of JEOL Ltd.) was used to observe the resultant flake sample and capture a cross-sectional image of toner particles therein.

<Measurement Method of Shell Layer Thickness>

The shell layer thickness was measured by analyzing the thus captured cross-sectional image of the toner particles using image analysis software ("WinROOF", product of Mitani Corporation). Specifically, two straight lines that perpendicularly intersected at substantially the center of a cross-section of one toner particle were drawn, and lengths of four segments where the two straight lines intersected the shell layer were measured. Subsequently, an arithmetic mean of the four measured values was determined to be a shell layer thickness of the one toner particle. The shell layer thickness was measured with respect to 20 toner particles included in the measurement target (toner), and a number average value of the 20 measured values was determined to be a measurement value (shell layer thickness) of the measurement target (toner).

<Measurement Method of Magnetic Particle Protrusion Amount>

The magnetic particle protrusion amount was measured by analyzing the cross-sectional image of the toner particles obtained as described above using image analysis software ("WinROOF", product of Mitani Corporation). A magnetic particle of which at least a portion was covered with a shell layer was used as a measurement target. A magnetic particle not covered with the shell layer at all and a magnetic particle detached from the toner mother particle were excluded as measurement targets. Specifically, the magnetic particle protrusion amount was calculated by dividing an area of a protrusion of the magnetic particle by an overall area of the magnetic particle. The magnetic particle protrusion amount can be expressed as a percentage (% by area) by multiplying the calculated value (=area of protrusion of magnetic particle/overall area of magnetic particle) by 100. The view of observation of one toner particle was varied while selecting 20 magnetic particles therein. Thus, the magnetic particle protrusion amount of each of the 20 magnetic particles was measured. An arithmetic mean of the 20 measured values for the magnetic particle protrusion amount was determined to be a measurement value (magnetic particle protrusion amount) of the one toner particle. The magnetic particle protrusion amount was measured with respect to 10 toner particles included in the measurement target (toner). A number average value of the 10 measured values from the 10 toner particles was determined to be an evaluation value (magnetic particle protrusion amount) of the measurement target (toner).

[Evaluation Methods]

Each sample (each of the toners TA-1 to TA-9 and TB-1 to TB-6) was evaluated as described below.

(Heat-Resistant Preservability)

With respect to each of the toners TA-1 to TA-9 and TB-1 to TB-6, a polyethylene container having a capacity of 20 mL was charged with 2 g of the toner (evaluation target) and left to stand for 3 hours in a thermostatic chamber set at 55° C. Thereafter, the toner was taken out of the thermostatic chamber and cooled to room temperature (approximately 25° C.) to obtain an evaluation toner.

Subsequently, the thus obtained evaluation toner was placed on a 200-mesh sieve (pore size: 75 μm) of known mass. The mass of the toner before sifting was calculated by measuring the total mass of the sieve and the evaluation toner thereon. Subsequently, the sieve was set in a powder property evaluation machine ("POWDER TESTER (registered Japanese trademark)", product of Hosokawa Micron Corporation) and the evaluation toner was sifted by shaking the sieve for 30 seconds at a rheostat level of 5 in accordance with a manual of POWDER TESTER. After the sifting, the mass of toner remaining on the sieve was calculated by measuring the total mass of the sieve and the toner thereon. An aggregation rate (unit: % by mass) was calculated from the mass of the toner before sifting and the mass of the toner after sifting (mass of toner remaining on the sieve after shifting) in accordance with a formula shown below.

$$\text{Aggregation rate} = 100 \times (\text{mass of toner after sifting}) / (\text{mass of toner before sifting})$$

Heat-resistant preservability was evaluated as "good" if the aggregation rate was lower than or equal to 10% by mass, evaluated as "mediocre" if the aggregation rate was higher than 10% by mass and lower than or equal to 30% by mass, and evaluated as "poor" if the aggregation rate was higher than 30% by mass.

(Fixability)

With respect to each of the toners TA-1 to TA-9 and TB-1 to TB-6, a two-component developer was prepared by mixing 100 parts by mass of a developer carrier (carrier for FS-C5250DN) with 5 parts by mass of the toner (evaluation target) for 30 minutes using a ball mill.

The two-component developer prepared as described above was used to form an image to determine a minimum fixable temperature and a width of fixing temperature range (fixing OW: fixing operation window). A printer (evaluation apparatus obtained by modifying "FS-C5250DN", product of KYOCERA Document Solutions Inc., to enable adjustment of fixing temperature) having a roller-roller type heat-pressure fixing device (nip width 8 mm) was used as an evaluation apparatus. The two-component developer prepared as described above with respect to each of the toners TA-1 to TA-9 and TB-1 to TB-6 was loaded into a developing device of the evaluation apparatus, and the toner (evaluation target) for replenishment use was loaded into a toner container of the evaluation apparatus.

The evaluation apparatus was used to form a solid image (specifically, unfixed toner image) having a size of 25 mm×25 mm on paper ("$C^2$90", A4 size 90 g/$m^2$ plain paper, product of Fuji Xerox Co., Ltd.) at a linear velocity of 200 mm/second and a toner application amount of 1.0 mg/cm$^2$ under environmental conditions of a temperature of 23° C. and a relative humidity of 55%. Subsequently, the paper with the image formed thereon was passed through the fixing device of the evaluation apparatus. It took the paper 40 milliseconds to pass through the nip.

The fixing temperature was measured within a range of from 100° C. to 200° C. to evaluate the minimum fixable temperature. The fixing temperature of the fixing device was increased in increments of a predetermined temperature from 100° C. to determine the minimum temperature at which the solid image (toner image) was fixable to the paper (minimum fixable temperature) and the maximum temperature at which offset did not occur (maximum fixable temperature).

For the minimum fixable temperature, determination of whether or not the toner was fixable was carried out through a fold-rubbing test described below. Specifically, the paper passed through the fixing device was folded with a surface on which the image was formed facing inward and a 1-kg weight covered with cloth was rubbed back and forth on the fold ten times. Subsequently, the paper was opened up and a fold portion (portion on which the solid image was formed) of the paper was observed. Then, the length of toner peeling of the fold portion (peeling length) was measured. The minimum fixable temperature was determined to be the lowest temperature among fixing temperatures for which the peeling length was no greater than 1 mm. Low-temperature fixability was evaluated as "good" if the minimum fixable temperature was lower than or equal to 130° C., evaluated as "mediocre" if the minimum fixable temperature was higher than 130° C. and lower than or equal to 140° C., and evaluated as "poor" if the minimum fixable temperature was higher than 140° C.

For the maximum fixable temperature, determination of whether or not offset occurred (the toner adhered to a fixing roller) on the paper passed through the fixing device was carried out by visual observation. The width of fixing temperature range (fixing OW) was calculated in accordance with the following formula: "width of fixing temperature range=maximum fixable temperature−minimum fixable temperature". The width of fixing temperature was evaluated as "good" if the width of fixing temperature range was at least 40° C. and evaluated as "poor" if the width of fixing temperature range was less than 40° C.

(Initial Amount of Charge and Initial Image Density)

With respect to each of the toners TA-1 to TA-9 and TB-1 to TB-6, an evaluation developer was prepared by mixing 100 parts by mass of a developer carrier (carrier for "FS-C5300DN", product of KYOCERA Document Solutions Inc.) with 10 parts by mass of the toner (evaluation target) for 30 minutes using a ball mill. Subsequently, the evaluation developer was left to stand in each of specific environments (H/H environment, N/N environment, and L/L environment) for 24 hours. The H/H environment was a high temperature and high humidity environment (temperature 32.5° C., relative humidity 80%). The N/N environment was a normal temperature and normal humidity environment (temperature 24° C., relative humidity 50%). The L/L environment was a low temperature and low humidity environment (temperature 10° C., relative humidity 10%). Thereafter, the amount of the charge of the toner in the evaluation developer was measured using a Q/m meter ("MODEL 210HS-2A", product of TREK, INC.) under the following conditions.

<Measurement Method of Amount of Charge of Toner in Developer>

Into a measurement cell of the Q/m meter, 0.10 g of the developer (the carrier and the toner) was loaded, and only the toner in the loaded developer was sucked through a sieve (metal mesh) for 10 seconds. The amount of the charge (unit: μC/g) of the toner in the developer was calculated in accordance with the following expression: "total amount of electricity of sucked toner (unit: μC)/mass of sucked toner (unit: g)".

Chargeability was evaluated as "good" if the amount of the charge was at least 15 μC/g and no greater than 25 μC/g, and evaluated as "poor" if the amount of the charge was less than 15 μC/g or greater than 25 μC/g.

Furthermore, an image was formed using the evaluation developer prepared as described above to measure an image density (ID) of the image. A printer ("FS-C5300DN", product of KYOCERA Document Solutions Inc.) was used as an evaluation apparatus. The evaluation developer prepared as described above with respect to each of the toners TA-1 to TA-9 and TB-1 to TB-6 was loaded into a developing device of the evaluation apparatus, and the toner (evaluation target) for replenishment use was loaded into a toner container of the evaluation apparatus. Thereafter, the evaluation apparatus was used to form a sample image including a solid portion and a blank portion on a recording medium (evaluation paper) in each of specific environments (H/H environment, N/N environment, and L/L environment). The H/H environment, the N/N environment, and the L/L environment were as defined above. The image density (ID) of the solid portion of each image formed on the recording medium was measured using a reflectance densitometer ("SPECTROEYE (registered Japanese trademark)", product of X-Rite Inc.).

An image density (ID) of at least 1.30 was evaluated as "good", and an image density (ID) of less than 1.30 was evaluated as "poor".

(Post-Printing Amount of Charge and Post-Printing Image Density)

A printing durability test was carried out by performing printing on 10,000 successive sheets at a coverage of 5% in each of specific environments (H/H environment, N/N environment, and L/L environment) using the same evaluation apparatus as that used for the evaluation of the initial amount of the charge and the initial image density. The H/H environment, the N/N environment, and the L/L environment were as defined above. After the printing durability test, the amount of the charge of the toner in the developer taken out of the developing device of the evaluation apparatus was measured. Furthermore, after the printing durability test, the evaluation apparatus was used to form a sample image including a solid portion and a blank portion on a recording medium (evaluation paper) in each of specific environments (the H/H environment, the N/N environment, and the L/L environment as defined above). The image density (ID) of each image formed as described above was measured.

Measurement methods and evaluation standards with respect to the post-printing amount of the charge and the post-printing image density (ID) were the same as those employed with respect to the initial amount of the charge and the initial image density.

Presence or absence of a prime mark shaped streak referred to as "a dash mark" was observed each time printing on 1,000 successive sheets was finished in the printing durability test. Specifically, the formed image was visually observed to determine presence or absence of a dash mark. Polishing characteristics were evaluated as "good" if no dash mark was observed, and evaluated as "poor" if a dash mark was observed. The dash mark is an image defect that may occur due to toner adhering to a surface of a photosensitive drum.

[Evaluation Results]

Tables 3 and 4 show evaluation results of the toners TA-1 to TA-9 and TB-1 to TB-6. Table 3 shows fixability (minimum fixable temperature and width of fixing temperature range), heat-resistant preservability (aggregation rate), and evaluation based on presence or absence of a dash mark ("good" or "poor"). Table 4 shows the amount of the charge (initial amount of charge and post-printing amount of charge of each toner in each environment) and ID (initial image density and post-printing image density in each environment). In Tables 3 and 4, "H/H" indicates a temperature of 32.5° C. and a relative humidity of 80%, "N/N" indicates a temperature of 24° C. and a relative humidity of 10%, and "L/L" indicates a temperature of 10° C. and a relative humidity of 10%. In Table 4, a value preceding each arrow "→" indicates an initial measurement value, and a value following each arrow "→" indicates a post-printing measurement value.

TABLE 3

| | | Fixability [° C.] | | Heat-resistant preserv-ability | Polishing characteristics (dash mark) | | |
|---|---|---|---|---|---|---|---|
| | Toner | Mini-mum | Width | [% by mass] | H/H | N/N | L/L |
| Example 1 | TA-1 | 127 | 45 | 5 | Good | Good | Good |
| Example 2 | TA-2 | 125 | 47 | 8 | Good | Good | Good |
| Example 3 | TA-3 | 128 | 44 | 3 | Good | Good | Good |
| Example 4 | TA-4 | 126 | 46 | 4 | Good | Good | Good |
| Example 5 | TA-5 | 128 | 44 | 5 | Good | Good | Good |
| Example 6 | TA-6 | 126 | 46 | 6 | Good | Good | Good |
| Example 7 | TA-7 | 127 | 46 | 5 | Good | Good | Good |
| Example 8 | TA-8 | 123 | 48 | 30 | Good | Good | Good |
| Example 9 | TA-9 | 138 | 42 | 3 | Good | Good | Good |
| Comparative Example 1 | TB-1 | 126 | 45 | 6 | Poor | Poor | Poor |
| Comparative Example 2 | TB-2 | 126 | 47 | 5 | Poor | Poor | Poor |
| Comparative Example 3 | TB-3 | 134 | 36 | 6 | Good | Good | Good |
| Comparative Example 4 | TB-4 | 125 | Poor 46 | 5 | Poor | Poor | Poor |
| Comparative Example 5 | TB-5 | 126 | 47 | 6 | Poor | Poor | Poor |
| Comparative Example 6 | TB-6 | 125 | 49 | 5 | Poor | Poor | Poor |

TABLE 4

| | H/H (Initial→Post-printing) | | N/N (Initial→Post-printing) | | L/L (Initial→Post-printing) | |
|---|---|---|---|---|---|---|
| Toner | Amount of charge [μC/g] | ID | Amount of charge [μC/g] | ID | Amount of charge [μC/g] | ID |
| TA-1 | 20→19 | 1.38→1.40 | 21→22 | 1.37→1.35 | 23→24 | 1.34→1.32 |
| TA-2 | 21→20 | 1.38→1.38 | 22→21 | 1.36→1.34 | 24→24 | 1.33→1.32 |
| TA-3 | 22→21 | 1.37→1.37 | 22→23 | 1.33→1.32 | 24→24 | 1.31→1.31 |
| TA-4 | 20→19 | 1.39→1.40 | 21→22 | 1.34→1.33 | 23→24 | 1.32→1.31 |
| TA-5 | 20→20 | 1.38→1.39 | 22→22 | 1.36→1.35 | 23→24 | 1.33→1.32 |
| TA-6 | 21→20 | 1.36→1.37 | 21→22 | 1.32→1.34 | 24→24 | 1.30→1.31 |
| TA-7 | 20→21 | 1.37→1.36 | 22→23 | 1.34→1.33 | 24→24 | 1.32→1.31 |
| TA-8 | 21→22 | 1.36→1.37 | 22→23 | 1.36→1.35 | 25→24 | 1.32→1.31 |
| TA-9 | 20→21 | 1.36→1.35 | 22→22 | 1.35→1.36 | 23→24 | 1.32→1.33 |
| TB-1 | 21→21 | 1.36→1.38 | 24→24 | 1.33→1.32 | 25→24 | 1.31→1.30 |
| TB-2 | 21→20 | 1.36→1.37 | 23→23 | 1.34→1.33 | 24→24 | 1.31→1.31 |
| TB-3 | 20→19 | 1.38→1.38 | 23→22 | 1.35→1.34 | 24→25 | 1.32→1.30 |
| TB-4 | 22→19 | 1.39→1.38 | 22→21 | 1.37→1.35 | 24→24 | 1.32→1.31 |
| TB-5 | 20→20 | 1.38→1.37 | 20→19 | 1.31→1.31 | 23→23 | 1.30→1.30 |
| TB-6 | 22→19 | 1.37→1.36 | 24→21 | 1.35→1.35 | 24→24 | 1.32→1.33 |

The toners TA-1 to TA-9 (toners according to Examples 1 to 9) each had the above-described basic features. Specifically, each of the toners TA-1 to TA-9 included toner particles each including a toner mother particle and an external additive (specifically, silica particles) adhering to a surface of the toner mother particle. The toner mother particle included a composite core (specifically, a composite of a toner core, organic particles, and magnetic particles) and a shell layer covering a surface of the composite core. Each of the magnetic particles had a polyhedral (specifically, octahedral) profile (see Tables 1 and 2). The organic particles each contained a releasing agent and adhered to a surface of the toner core. The magnetic particles included magnetic particles adhering to the surface of the toner core and magnetic particles adhering to surfaces of the organic particles. The amount of the magnetic particles was at least 0.5 parts by mass and no greater than 2.0 parts by mass relative to 100 parts by mass of the toner cores (see Table 1). In a cross-sectional image of each toner particle, the area of protruding portions of the respective magnetic particles, which are portions protruding from the shell layer, accounted for at least 10% and no greater than 75% of the overall area of the magnetic particles (see Table 1).

The toners TA-1 to TA-9 also each had the following features. The surface of each shell layer had projections corresponding to the organic particles of the composite core. Through observation of a cross-sectional image of toner particles using a transmission electron microscope (TEM), it was found that the number average primary particle diameter of the organic particles was the same as that at the time of addition thereof. Each shell layer contained no releasing agent inside the film. Each shell layer covered at least 70% and no greater than 80% of the surface area of the corresponding toner core.

As indicated by Tables 3 and 4, the toners TA-1 to TA-9 were each excellent in fixability (low-temperature fixability and hot offset resistance), chargeability (initial chargeability and chargeability after printing durability test), and heat-resistant preservability. The toners TA-1 to TA-9 were each excellent in releasability. Accordingly, offset was sufficiently prevented in toner images resulting from these toners. Furthermore, the use of the toners TA-1 to TA-9 allowed formation of high-quality images both in initial image formation and in image formation after the printing durability test while preventing occurrence of a dash mark by polishing the photosensitive drum.

The toners TB-1, TB-2, and TB-4 to TB-6 (toners according to Comparative Examples 1, 2, and 4 to 6) resulted in occurrence of a dash mark. This is thought to be for the following reasons. As for the toner TB-1, the magnetic powder M-2 (see Table 2) provided insufficient polishing characteristics. As for each of the toners TB-2 and TB-6, the amount (see Table 1) of the magnetic particles for polishing the photosensitive drum was insufficient. As for the toner TB-4, the magnetic particle protrusion amount (see Table 1) was insufficient. As for the toner TB-5, a great amount of magnetic particles were detached. As a result, the amount of the magnetic particles for polishing the photosensitive drum became insufficient.

In the toner TB-3 (toner according to Comparative Example 3), the amount (see Table 1) of the magnetic particles for polishing the photosensitive drum was too large, and some of the magnetic particles limited fixation of the toner.

What is claimed is:

1. An electrostatic latent image developing toner comprising toner particles each including a toner mother particle and an external additive adhering to a surface of the toner mother particle, wherein the toner mother particle includes a composite core and a shell layer covering a surface of the composite core, the composite core is a composite of a toner core, organic particles, and polyhedral magnetic particles, the organic particles each contain a releasing agent and adhere to a surface of the toner core, the magnetic particles include magnetic particles adhering to the surface of the toner core and magnetic particles adhering to surfaces of the organic particles, an amount of the magnetic particles is at least 0.5 parts by mass and no greater than 2.0 parts by mass relative to 100 parts by mass of the toner cores, and in a cross-sectional image of each toner particle, an area of protruding portions of the respective magnetic particles accounts for at least 10% and no greater than 75% of an overall area of the magnetic particles, the protruding portions protruding from the shell layer.

2. The electrostatic latent image developing toner according to claim 1, wherein the shell layer has a thickness of at least 20 nm and no greater than 70 nm, the organic particles have a number average primary particle diameter of at least 80 nm and no greater than 150 nm, and the magnetic particles have a number average primary particle diameter of at least 100 nm and no greater than 120 nm.

3. The electrostatic latent image developing toner according to claim 2, wherein the shell layer contains a first resin having a glass transition point of at least 50° C. and no greater than 90° C., and the organic particles contain a second resin having a glass transition point of at least 90° C. and no greater than 110° C.

4. The electrostatic latent image developing toner according to claim 3, wherein the organic particles contain, as the releasing agent, at least one releasing agent selected from the group consisting of ester waxes and hydrocarbon waxes, the organic particles contain, as the second resin, a polymer of monomers including at least one styrene-based monomer, at least one (meth)acrylic acid ester, and acrylic acid, and the shell layer contains, as the first resin, a polymer of monomers including at least one styrene-based monomer, at least one (meth)acrylic acid ester, and acrylic acid.

5. The electrostatic latent image developing toner according to claim 1, wherein the toner core contains a non-crystalline polyester resin and a crystalline polyester resin.

6. The electrostatic latent image developing toner according to claim 1, wherein the shell layer is a resin film having a shape along the surface of the underlying toner core and the surfaces of the underlying organic particles, the surface of the toner mother particle has projections and recesses according to presence and absence of the organic particles on the surface of the toner core, an amount of the organic particles is at least 0.5 parts by mass and no greater than 30 parts by mass relative to 100 parts by mass of the toner cores, an amount of the releasing agent in the organic particles is at least 1% by mass and no greater than 30% by mass relative to overall mass of the organic particles, no magnetic particles are present inside the toner core, and the shell layer contains no releasing agent inside the resin film.

7. The electrostatic latent image developing toner according to claim 1, wherein a surface of the shell layer has projections corresponding to the organic particles.

8. A two-component developer comprising:

the electrostatic latent image developing toner according to claim 1; and a carrier configured to positively charge the toner by friction therewith.

* * * * *